US006264760B1

(12) United States Patent
Tamehiro et al.

(10) Patent No.: US 6,264,760 B1
(45) Date of Patent: Jul. 24, 2001

(54) ULTRA-HIGH STRENGTH, WELDABLE STEELS WITH EXCELLENT ULTRA-LOW TEMPERATURE TOUGHNESS

(75) Inventors: Hiroshi Tamehiro; Hitoshi Asahi; Takuya Hara; Yoshio Terada, all of Chiba Prefecture (JP); Michael J. Luton; Jayoung Koo, both of Bridgewater, NJ (US); Narasimha-Rao V. Bangaru, Annandale, NJ (US); Clifford W. Petersen, Missouri City, TX (US)

(73) Assignees: ExxonMobil Upstream Research Company, Houston, TX (US); Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/123,625

(22) Filed: Jul. 28, 1998

Related U.S. Application Data

(60) Provisional application No. 60/053,915, filed on Jul. 28, 1997.

(51) Int. Cl.[7] ..... C22C 38/08; C22C 38/04; C22C 38/38; C21D 8/02

(52) U.S. Cl. ..... 148/336; 148/654; 148/661; 148/335; 148/330

(58) Field of Search ..... 148/320, 654, 148/661, 330, 336, 335

(56) References Cited

U.S. PATENT DOCUMENTS

| | | | |
|---|---|---|---|
| 5,531,842 | 7/1996 | Koo et al. | 148/654 |
| 5,545,269 | 8/1996 | Koo et al. | 148/654 |
| 5,545,270 | 8/1996 | Koo et al. | 148/654 |
| 5,653,826 | 8/1997 | Koo et al. | 148/328 |
| 5,755,895 | 5/1998 | Tamehiro et al. | 148/336 |
| 5,798,004 | 8/1998 | Tamehiro et al. | 148/336 |
| 5,900,075 | 5/1999 | Koo et al. | 148/328 |

FOREIGN PATENT DOCUMENTS

| | | |
|---|---|---|
| 57-134514 | 8/1982 | (JP) . |
| 58-52423 | 3/1983 | (JP) . |
| 7-292416 | 11/1995 | (JP) . |
| 7-331328 | 12/1995 | (JP) . |
| 8-104922 | 4/1996 | (JP) . |
| 8-176659 | 7/1996 | (JP) . |
| 8-295982 | 11/1996 | (JP) . |
| 8-311548 | 11/1996 | (JP) . |
| 8-311549 | 11/1996 | (JP) . |
| 8-311550 | 11/1996 | (JP) . |
| 9-31536 | 2/1997 | (JP) . |
| 9-41074 | 2/1997 | (JP) . |

*Primary Examiner*—Deborah Yee
(74) *Attorney, Agent, or Firm*—Marcy Hoefling

(57) ABSTRACT

An ultra-high strength steel having excellent ultra-low temperature toughness, a tensile strength of at least about 930 MPa (135 ksi), and a microstructure comprising predominantly fine-grained lower bainite, fine-grained lath martensite, or mixtures thereof, transformed from substantially unrecrystallized austenite grains and comprising iron and specified weight percentages of the additives: carbon, silicon, manganese, copper, nickel, niobium, vanadium, molybdenum, chromium, titanium, aluminum, calcium, Rare Earth Metals, and magnesium, is prepared by heating a steel slab to a suitable temperature; reducing the slab to form plate in one or more hot rolling passes in a first temperature range in which austenite recrystallizes; further reducing said plate in one or more hot rolling passes in a second temperature range below said first temperature range and above the temperature at which austenite begins to transform to ferrite during cooling; quenching said plate to a suitable Quench Stop Temperature; and stopping said quenching and allowing said plate to air cool to ambient temperature.

40 Claims, 9 Drawing Sheets

ULTRA-HIGH STRENGTH, WELDABLE STEELS WITH EXCELLENT ULTRA-LOW TEMPERATURE TOUGHNESS

This application claims the benefit of U.S. Provisional Application No. 60/053915, filed Jul. 28, 1997.

FIELD OF THE INVENTION

This invention relates to ultra-high strength, weldable steel plate with superior toughness, and to linepipe fabricated therefrom. More particularly, this invention relates to ultra-high strength, high toughness, weldable, low alloy linepipe steels where loss of strength of the HAZ, relative to the remainder of the linepipe, is minimized, and to a method for producing steel plate which is a precursor for the linepipe.

BACKGROUND OF THE INVENTION

Various terms are defined in the following specification. For convenience, a Glossary of terms is provided herein, immediately preceding the claims.

Currently, the highest yield strength linepipe in commercial use exhibits a yield strength of about 550 MPa (80 ksi). Higher strength linepipe steel is commercially available, e.g., up to about 690 MPa (100 ksi), but to our knowledge has not been commercially used for fabricating a pipeline. Furthermore, as is disclosed in U.S. Pat. Nos. 5,545,269, 5,545,270 and 5,531,842, of Koo and Luton, it has been found to be practical to produce superior strength steels having yield strengths of at least about 830 MPa (120 ksi) and tensile strengths of at least about 900 MPa (130 ksi), as precursors to linepipe. The strengths of the steels described by Koo and Luton in U.S. Pat. No. 5,545,269 are achieved by a balance between steel chemistry and processing techniques whereby a substantially uniform microstructure is produced that comprises primarily fine-grained, tempered martensite and bainite which are secondarily hardened by precipitates of ϵ-copper and certain carbides or nitrides or carbonitrides of vanadium, niobium and molybdenum.

In U.S. Pat. No. 5,545,269, Koo and Luton describe a method of making high strength steel wherein the steel is quenched from the finish hot rolling temperature to a temperature no higher than 400° C. (752° F.) at a rate of at least 20° C./second (36° F./second), preferably about 30° C./second (54° F./second), to produce primarily martensite and bainite microstructures. Furthermore, for the attainment of the desired microstructure and properties, the invention by Koo and Luton requires that the steel plate be subjected to a secondary hardening procedure by an additional processing step involving the tempering of the water cooled plate at a temperature no higher than the $Ac_1$ transformation point, i.e., the temperature at which austenite begins to form during heating, for a period of time sufficient to cause the precipitation of ϵ-copper and certain carbides or nitrides or carbonitrides of vanadium, niobium and molybdenum. The additional processing step of post-quench tempering adds significantly to the cost of the steel plate. It is desirable, therefore, to provide new processing methodologies for the steel that dispense with the tempering step while still attaining the desired mechanical properties. Furthermore, the tempering step, while necessary for the secondary hardening required to produce the desired microstructures and properties, also leads to a yield to tensile strength ratio of over 0.93. From the point of view of preferred pipeline design, it is desirable to keep the yield to tensile strength ratio lower than about 0.93, while maintaining high yield and tensile strengths.

There is a need for pipelines with higher strengths than are currently available to carry crude oil and natural gas over long distances. This need is driven by the necessity to (i) increase transport efficiency through the use of higher gas pressures and, (ii) decrease materials and laying costs by reducing the wall thickness and outside diameter. As a result the demand has increased for linepipe stronger than any that is currently available.

Consequently, an object of the current invention is to provide compositions of steel and processing alternatives for the production of low cost, low alloy, ultra-high strength steel plate, and linepipe fabricated therefrom, wherein the high strength properties are obtained without the need for a tempering step to produce secondary hardening. Furthermore, another object of the current invention is to provide high strength steel plate for linepipe that is suitable for pipeline design, wherein the yield to tensile strength ratio is less than about 0.93.

A problem relating to most high strength steels, i.e., steels having yield strengths greater than about 550 MPa (80 ksi), is the softening of the HAZ after welding. The HAZ may undergo local phase transformation or annealing during welding-induced thermal cycles, leading to a significant, i.e., up to about 15 percent or more, softening of the HAZ as compared to the base metal. While ultra-high strength steels have been produced with yield strengths of 830 MPa (120 ksi) or higher, these steels generally lack the toughness necessary for linepipe, and fail to meet the weldability requirements necessary for linepipe, because such materials have a relatively high Pcm (a well-known industry term used to express weldability), generally greater than about 0.35.

Consequently, another object of this invention is to produce low alloy, ultra-high strength steel plate, as a precursor for linepipe, having a yield strength at least about 690 MPa (100 ksi), a tensile strength of at least about 900 MPa (130 ksi), and sufficient toughness for applications at low temperatures, i.e., down to about −40° C. (−40° F.), while maintaining consistent product quality, and minimizing loss of strength in the HAZ during the welding-induced thermal cycle.

A further object of this invention is to provide an ultra-high strength steel with the toughness and weldability necessary for linepipe and having a Pcm of less than about 0.35. Although widely used in the context of weldability, both Pcm and Ceq (carbon equivalent), another well-known industry term used to express weldability, also reflect the hardenability of a steel, in that they provide guidance regarding the propensity of the steel to produce hard microstructures in the base metal. As used in this specification, Pcm is defined as: Pcm=wt % C+wt % Si/30+(wt % Mn+wt % Cu+wt % Cr)/20+wt % Ni/60+wt % Mo/15+wt % V/10+5(wt % B); and Ceq is defined as: Ceq=wt % C+wt % Mn/6+(wt % Cr+wt % Mo+wt % V)/5+(wt % Cu+wt % Ni)/15.

SUMMARY OF THE INVENTION

As described in U.S. Pat. No. 5,545,269, it had been found that, under the conditions described therein, the step of water-quenching to a temperature no higher than 400° C. (752° F.) (preferably to ambient temperature), following finish rolling of ultra-high strength steels, should not be replaced by air cooling because, under such conditions, air cooling can cause austenite to transform to ferrite/pearlite aggregates, leading to a deterioration in the strength of the steels.

It had also been determined that terminating the water cooling of such steels above 400° C. (752° F.) can cause insufficient transformation hardening during the cooling, thereby reducing the strength of the steels.

In steel plates produced by the process described in U.S. Pat. No. 5,545,269, tempering after the water cooling, for example, by reheating to temperatures in the range of about 400° C. to about 700° C. (752° F.–1292° F.) for predetermined time intervals, is used to provide uniform hardening throughout the steel plate and improve the toughness of the steel. The Charpy V-notch impact test is a well-known test for measuring the toughness of steels. One of the measurements that can be obtained by use of the Charpy V-notch impact test is the energy absorbed in breaking a steel sample (impact energy) at a given temperature, e.g., impact energy at −40° C. (−40° F.), ($vE_{-40}$), or at −20° C. (−4° F.), ($vE_{-20}$). Another important measurement is transition temperature determined by Charpy V-notch impact test (vTrs). For example, 50% vTrs represents the experimental measurement and extrapolation from Charpy V-notch impact test of the lowest temperature at which the fracture surface displays 50% by area shear fracture.

Subsequent to the developments described in U.S. Pat. No. 5,545,269, it has been discovered that ultra-high strength steel with high toughness can be produced without the need for the costly step of final tempering. This desirable result has been found to be achievable by interrupting the quenching in a particular temperature range, dependent on the particular chemistry of the steel, upon which a microstructure comprising predominantly fine-grained lower bainite, fine-grained lath martensite, or mixtures thereof, develops at the interrupted cooling temperature or upon subsequent air cooling to ambient temperature. It has also been discovered that this new sequence of processing steps provides the surprising and unexpected result of steel plates with even higher strength and toughness than were achievable heretofore.

Consistent with the above-stated objects of the present invention, a processing methodology is provided, referred to herein as Interrupted Direct Quenching (IDQ), wherein low alloy steel plate of the desired chemistry is rapidly cooled, at the end of hot rolling, by quenching with a suitable fluid, such as water, to a suitable Quench Stop Temperature (QST), followed by air cooling to ambient temperature, to produce a microstructure comprising predominantly fine-grained lower bainite, fine-grained lath martensite, or mixtures thereof. As used in describing the present invention, quenching refers to accelerated cooling by any means whereby a fluid selected for its tendency to increase the cooling rate of the steel is utilized, as opposed to air cooling the steel to ambient temperature.

The present invention provides steels with the ability to accommodate a regime of cooling rate and QST parameters to provide hardening, for the partial quenching process referred to as IDQ, followed by an air cooling phase, so as to produce a microstructure comprising predominantly fine-grained lower bainite, fine-grained lath martensite, or mixtures thereof, in the finished plate.

It is well known in the art that additions of small amounts of boron, on the order of 5 to 20 ppm, can have a substantial effect on the hardenability of low carbon, low alloy steels. Thus, boron additions to steel have been effectively used in the past to produce hard phases, such as martensite, in low alloy steels with lean chemistries, i.e., low carbon equivalent (Ceq), for low cost, high strength steels with superior weldability. Consistent control of the desired, small additions of boron, however, is not easily achieved. It requires technically advanced steel-making facilities and know how.

The present invention provides a range of steel chemistries, with and without added boron, that can be processed by the IDQ methodology to produce the desirable microstructures and properties.

In accordance with this invention, a balance between steel chemistry and processing technique is achieved, thereby allowing the manufacture of high strength steel plates having a yield strength of at least about 690 MPa (100 ksi), more preferably at least about 760 MPa (110 ksi), and even more preferably at least about 830 MPa (120 ksi), and preferably, a yield to tensile strength ratio of less than about 0.93, more preferably less than about 0.90, and even more preferably less than about 0.85, from which linepipe may be prepared. In these steel plates, after welding in linepipe applications, the loss of strength in the HAZ is less than about 10%, preferably less than about 5%, relative to the strength of the base steel. Additionally, these ultra-high strength, low alloy steel plates, suitable for fabricating linepipe, have a thickness of preferably at least about 10 mm (0.39 inch), more preferably at least about 15 mm (0.59 inch), and even more preferably at least about 20 mm (0.79 inch). Further, these ultra-high strength, low alloy steel plates either do not contain added boron, or, for particular purposes, contain added boron in amounts of between about 5 ppm to about 20 ppm, and preferably between about 8 ppm to about 12 ppm. The linepipe product quality remains substantially consistent and is generally not susceptible to hydrogen assisted cracking.

The preferred steel product has a substantially uniform microstructure preferably comprising predominantly fine-grained lower bainite, fine-grained lath martensite, or mixtures thereof. Preferably, the fine-grained lath martensite comprises auto-tempered fine-grained lath martensite. As used in describing the present invention, and in the claims, "predominantly" means at least about 50 volume percent. The remainder of the microstructure can comprise additional fine-grained lower bainite, additional fine-grained lath martensite, upper bainite, or ferrite. More preferably, the microstructure comprises at least about 60 volume percent to about 80 volume percent fine-grained lower bainite, fine-grained lath martensite, or mixtures thereof. Even more preferably, the microstructure comprises at least about 90 volume percent fine-grained lower bainite, fine-grained lath martensite, or mixtures thereof.

Both the lower bainite and the lath martensite may be additionally hardened by precipitates of the carbides or carbonitrides of vanadium, niobium and molybdenum. These precipitates, especially those containing vanadium, can assist in minimizing HAZ softening, likely by preventing any substantial reduction of dislocation density in regions heated to temperatures no higher than the $Ac_1$ transformation point or by inducing precipitation hardening in regions heated to temperatures above the $Ac_1$ transformation point, or both.

The steel plate of this invention is manufactured by preparing a steel slab in a customary fashion and, in one embodiment, comprising iron and the following alloying elements in the weight percents indicated:

0.03–0.10% carbon (C), preferably 0.05–0.09% C
0–0.6% silicon (Si)
1.6–2.1% manganese (Mn)
0–1.0% copper (Cu)
0–1.0% nickel (Ni), preferably 0.2 to 1.0% Ni
50.01–0.10% niobium (Nb), preferably 0.03–0.06% Nb
0.01–0.10% vanadium (V), preferably 0.03–0.08% V
0.3–0.6% molybdenum (Mo)
0–1.0% chromium (Cr)

0.005–0.03% titanium (Ti), preferably 0.015–0.02% Ti
100–0.06% aluminum (Al), preferably 0.001–0.06% Al
0–0.006% calcium (Ca)
0–0.02% Rare Earth Metals (REM)
0–0.006% magnesium (Mg)
and further characterized by:
Ceq≦0.7, and
Pcm≦0.35, Alternatively, the chemistry set forth above is modified and includes 0.0005–0.0020 wt % boron (B), preferably 0.0008–0.0012 wt % B, and the Mo content is 0.2–0.5 wt %.

For essentially boron-free steels of this invention, Ceq is preferably greater than about 0.5 and less than about 0.7. For boron-containing steels of this invention, Ceq is preferably greater than about 0.3 and less than about 0.7.

Additionally, the well-known impurities nitrogen (N), phosphorous (P), and sulfur (S) are preferably minimized in the steel, even though some N is desired, as explained below, for providing grain growth-inhibiting titanium nitride particles. Preferably, the N concentration is about 0.001 to about 0.006 wt %, the S concentration no more than about 0.005 wt %, more preferably no more than about 0.002 wt %, and the P concentration no more than about 0.015 wt %. In this chemistry the steel either is essentially boron-free in that there is no added boron, and the boron concentration is preferably less than about 3 ppm, more preferably less than about 1 ppm, or the steel contains added boron as stated above.

In accordance with the present invention, a preferred method for producing an ultra-high strength steel having a microstructure comprising predominantly fine-grained lower bainite, fine-grained lath martensite, or mixtures thereof, comprises heating a steel slab to a temperature sufficient to dissolve substantially all carbides and carbonitrides of vanadium and niobium; reducing the slab to form plate in one or more hot rolling passes in a first temperature range in which austenite recrystallizes; further reducing the plate in one or more hot rolling passes in a second temperature range below the $T_{nr}$ temperature, i.e., the temperature below which austenite does not recrystallize, and above the $Ar_3$ transformation point, i.e., the temperature at which austenite begins to transform to ferrite during cooling; quenching the finished rolled plate to a temperature at least as low as the $Ar_1$ transformation point, i.e., the temperature at which transformation of austenite to ferrite or to ferrite plus cementite is completed during cooling, preferably to a temperature between about 550° C. and about 150° C. (1022° F.–302° F.), and more preferably to a temperature between about 500° C. and about 150° C. (932° F.–302° F.); stopping the quenching; and air cooling the quenched plate to ambient temperature.

The $T_{nr}$ temperature, the $Ar_1$ transformation point, and the $Ar_3$ transformation point each depend on the chemistry of the steel slab and are readily determined either by experiment or by calculation using suitable models.

An ultra-high strength, low alloy steel according to a first preferred embodiment of the invention exhibits a tensile strength of preferably at least about 900 MPa (130 ksi), more preferably at least about 930 MPa (135 ksi), has a microstructure comprising predominantly fine-grained lower bainite, fine-grained lath martensite, or mixtures thereof, and further, comprises fine precipitates of cementite and, optionally, even more finely divided precipitates of the carbides, or carbonitrides of vanadium, niobium, and molybdenum. Preferably, the fine-grained lath martensite comprises auto-tempered fine-grained lath martensite.

An ultra-high strength, low alloy steel according to a second preferred embodiment of the invention exhibits a tensile strength of preferably at least about 900 MPa (130 ksi), more preferably at least about 930 MPa (135 ksi), and has a microstructure comprising fine-grained lower bainite, fine-grained lath martensite, or mixtures thereof, and further, comprises boron and fine precipitates of cementite and, optionally, even more finely divided precipitates of the carbides or carbonitrides of vanadium, niobium, molybdenum. Preferably, the fine-grained lath martensite comprises auto-tempered fine-grained lath martensite.

DESCRIPTION OF THE DRAWINGS

FIG. 2B shows well-developed cementite precipitates within the martensite laths.

Figure 1:
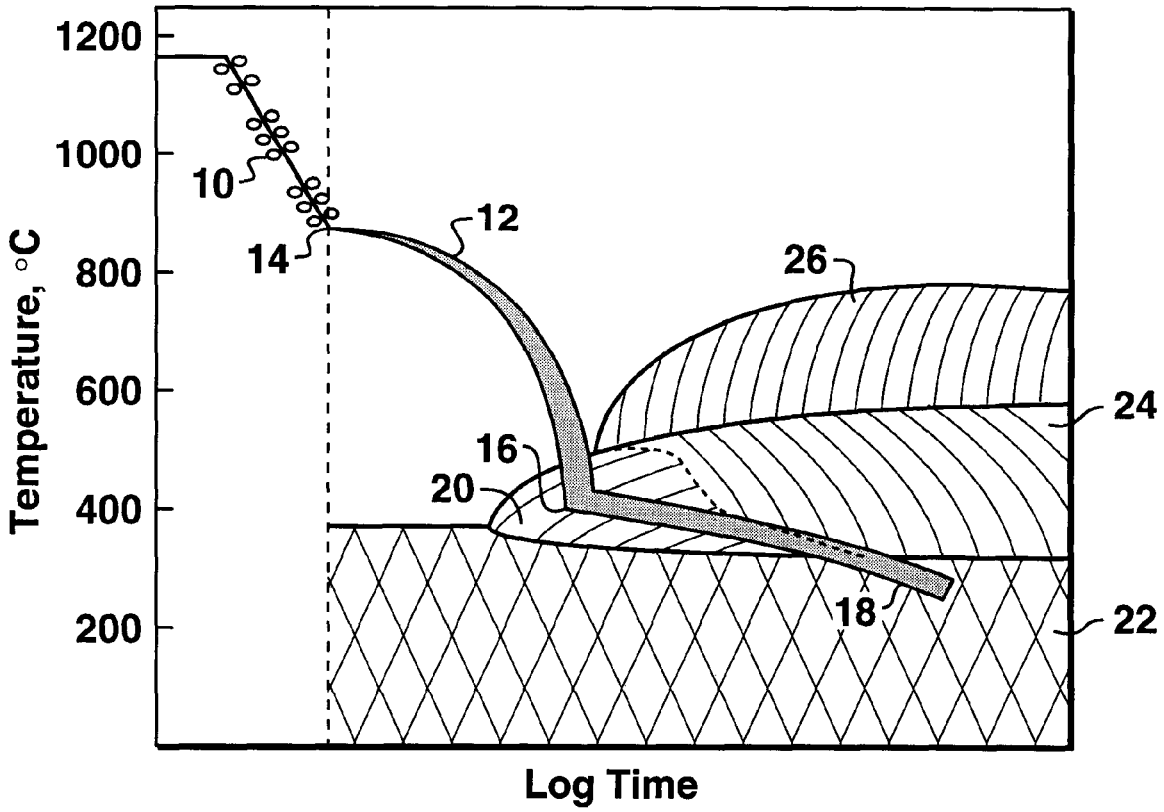
FIG. 1 is a schematic illustration of the processing steps of the present invention, with an overlay of the various microstructural constituents associated with particular combinations of elapsed process time and temperature.

While the invention will be described in connection with its preferred embodiments, it will be understood that the invention is not limited thereto. On the contrary, the invention is intended to cover all alternatives, modifications, and equivalents which may be included within the spirit and scope of the invention, as defined by the appended claims.

DETAILED DESCRIPTION OF THE INVENTION

In accordance with one aspect of the present invention, a steel slab is processed by: heating the slab to a substantially uniform temperature sufficient to dissolve substantially all carbides and carbonitrides of vanadium and niobium, preferably in the range of about 1000° C. to about 1250° C. (1832° F.–2282° F.), and more preferably in the range of about 1050° C. to about 1150° C. (1922° F.–2102° F.); a first hot rolling of the slab to a reduction of preferably about 20% to about 60% (in thickness) to form plate in one or more passes within a first temperature range in which austenite recrystallizes; a second hot rolling to a reduction of preferably about 40% to about 80% (in thickness) in one or more passes within a second temperature range, somewhat lower than the first temperature range, at which austenite does not recrystallize and above the $Ar_3$ transformation point; hardening the rolled plate by quenching at a rate of at least about 10° C./second (18° F./second), preferably at least about 20° C./second (36° F./second), more preferably at least about 30° C./second (54° F./second), and even more preferably at least about 35° C./second (63° F./second), from a temperature no lower than the $Ar_3$ transformation point to a Quench Stop Temperature (QST) at least as low as the $Ar_1$ transformation point, preferably in the range of about 550° C. to about 150° C. (1022° F.–302° F.), and more preferably in the range of about 500° C. to about 150° C. (932° F.–302° F.), and stopping the quenching and allowing the steel plate to air cool to ambient temperature, so as to facilitate completion of transformation of the steel to predominantly fine-grained lower bainite, fine-grained lath martensite, or mixtures thereof. As is understood by those skilled in the art, as used herein "percent reduction in thickness" refers to percent reduction in the thickness of the steel slab or plate prior to the reduction referenced. For purposes of example only, without thereby limiting this invention, a steel slab of about 25.4 cm (10 inches) may be reduced about 50% (a 50 percent reduction), in a first temperature range, to a thickness of about 12.7 cm (5 inches) then reduced about 80% (an 80 percent reduction), in a second temperature range, to a thickness of about 2.54 cm (1 inch).

For example, referring to FIG. 1, a steel plate processed according to this invention undergoes controlled rolling 10 within the temperature ranges indicated (as described in greater detail hereinafter); then the steel undergoes quenching 12 from the start quench point 14 until the Quench Stop Temperature (QST) 16. After quenching is stopped, the steel is allowed to air cool 18 to ambient temperature to facilitate transformation of the steel plate to predominantly fine-grained lower bainite (in the lower bainite region 20); fine-grained lath martensite (in the martensite region 22); or mixtures thereof. The upper bainite region 24 and ferrite region 26 are avoided.

Ultra-high strength steels necessarily require a variety of properties and these properties are produced by a combination of alloying elements and thermomechanical treatments; generally small changes in chemistry of the steel can lead to large changes in the product characteristics. The role of the various alloying elements and the preferred limits on their concentrations for the present invention are given below:

Carbon provides matrix strengthening in steels and welds, whatever the microstructure, and also provides precipitation strengthening, primarily through the formation of small iron carbides (cementite), carbonitrides of niobium [Nb(C,N)], carbonitrides of vanadium [V(C,N)], and particles or precipitates of $Mo_2C$ (a form of molybdenum carbide), if they are sufficiently fine and numerous. In addition, Nb(C,N) precipitation, during hot rolling, generally serves to retard austenite recrystallization and to inhibit grain growth, thereby providing a means of austenite grain refinement and leading to an improvement in both yield and tensile strength and in low temperature toughness (e.g., impact energy in the Charpy test). Carbon also increases hardenability, i.e., the ability to form harder and stronger microstructures in the steel during cooling. Generally if the carbon content is less than about 0.03 wt %, these strengthening effects are not obtained. If the carbon content is greater than about 0.10 wt %, the steel is generally susceptible to cold cracking after field welding and to lowering of toughness in the steel plate and in its weld HAZ.

Manganese is essential for obtaining the microstructures required according to the current invention, which contain fine-grained lower bainite, fine-grained lath martensite, or mixtures thereof, and which give rise to a good balance between strength and low temperature toughness. For this purpose, the lower limit is set at about 1.6 wt %. The upper limit is set at about 2.1 wt %, because manganese content in excess of about 2.1 wt % tends to promote centerline segregation in continuously cast steels, and can also lead to a deterioration of the steel toughness. Furthermore, high manganese content tends to excessively enhance the hardenability of steel and thereby reduce field weldability by lowering the toughness of the heat-affected zone of welds.

Silicon is added for deoxidation and improvement in strength. The upper limit is set at about 0.6 wt % to avoid the significant deterioration of field weldability and the toughness of the heat-affected zone (HAZ), that can result from excessive silicon content. Silicon is not always necessary for deoxidation since aluminum or titanium can perform the same function.

Niobium is added to promote grain refinement of the rolled microstructure of the steel, which improves both the strength and the toughness. Niobium carbonitride precipitation during hot rolling serves to retard recrystallization and to inhibit grain growth, thereby providing a means of austenite grain refinement. It can also give additional strengthening during final cooling through the formation of Nb(C,N) precipitates. In the presence of molybdenum, niobium effectively refines the microstructure by suppressing austenite recrystallization during controlled rolling and strengthens the steel by providing precipitation hardening and contributing to the enhancement of hardenability. In the presence of boron, niobium synergistically improves hardenability. To obtain such effects, at least about 0.01 wt % of niobium is preferably added. However, niobium in excess of about 0.10 wt % will generally be harmful to the weldability and HAZ toughness, so a maximum of about 0.10 wt % is preferred. More preferably, about 0.03 wt % to about 0.06 wt % niobium is added.

Titanium forms fine-grained titanium nitride particles and contributes to the refinement of the microstructure by suppressing the coarsening of austenite grains during slab reheating. In addition, the presence of titanium nitride particles inhibits grain coarsening in the heat-affected zones of welds. Accordingly, titanium serves to improve the low temperature toughness of both the base metal and weld heat-affected zones. Since titanium fixes the free nitrogen, in the form of titanium nitride, it prevents the detrimental effect of nitrogen on hardenability due to formation of boron nitride. The quantity of titanium added for this purpose is preferably at least about 3.4 times the quantity of nitrogen (by weight). When the aluminum content is low (i.e. less than about 0.005 weight percent), titanium forms an oxide that serves as the nucleus for the intragranular ferrite formation in the heat-affected zone of welds and thereby refines the microstructure in these regions. To achieve these goals, a titanium addition of at least about 0.005 weight percent is preferred. The upper limit is set at about 0.03 weight percent since excessive titanium content leads to coarsening of the titanium nitride and to titanium-carbide-induced precipitation hardening, both of which cause a deterioration of the low temperature toughness.

Copper increases the strength of the base metal and of the HAZ of welds; however excessive addition of copper greatly deteriorates the toughness of the heat-affected zone and field weldability. Therefore, the upper limit of copper addition is set at about 1.0 weight percent.

Nickel is added to improve the properties of the low-carbon steels prepared according to the current invention without impairing field weldability and low temperature toughness. In contrast to manganese and molybdenum, nickel additions tend to form less of the hardened microstructural constituents that are detrimental to low temperature toughness in the plate. Nickel additions, in amounts greater than 0.2 weight percent have proved to be effective in the improvement of the toughness of the heat-affected zone of welds. Nickel is generally a beneficial element, except for the tendency to promote sulfide stress cracking in certain environments when the nickel content is greater than about 2 weight percent. For steels prepared according to this invention, the upper limit is set at about 1.0 weight percent since nickel tends to be a costly alloying element and can deteriorate the toughness of the heat-affected zone of welds. Nickel addition is also effective for the prevention of copper-induced surface cracking during continuous casting and hot rolling. Nickel added for this purpose is preferably greater than about ⅓ of copper content.

Aluminum is generally added to these steels for the purpose of deoxidation. Also, aluminum is effective in the refinement of steel microstructures. Aluminum can also play an important role in providing HAZ toughness by the elimination of free nitrogen in the coarse grain HAZ region where the heat of welding allows the TiN to partially dissolve, thereby liberating nitrogen. If the aluminum content is too high, i.e., above about 0.06 weight percent, there is a tendency to form $Al_2O_3$ (aluminum oxide) type inclusions, which can be detrimental to the toughness of the steel and its HAZ. Deoxidation can be accomplished by titanium or silicon additions, and aluminum need not be always added.

Vanadium has a similar, but less pronounced, effect to that of niobium. However, the addition of vanadium to ultra-high strength steels produces a remarkable effect when added in combination with niobium. The combined addition of niobium and vanadium further enhances the excellent properties of the steels according to this invention. Although the preferable upper limit is about 0.10 weight percent, from the viewpoint of the toughness of the heat-affected zone of welds and, therefore, field weldability, a particularly preferable range is from about 0.03 to about 0.08 weight percent.

Molybdenum is added to improve the hardenability of steel and thereby promote the formation of the desired lower bainite microstructure. The impact of molybdenum on the hardenability of the steel is particularly pronounced in boron-containing steels. When molybdenum is added together with niobium, molybdenum augments the suppression of austenite recrystallization during controlled rolling and, thereby, contributes to the refinement of austenite microstructure. To achieve these effects, the amount of molybdenum added to essentially boron-free and boron-containing steels is, respectively, preferably at least about 0.3 weight percent and about 0.2 weight percent. The upper limit is preferably about 0.6 weight percent and about 0.5 weight percent for essentially boron-free and boron-containing steels, respectively, because excessive amounts of molybdenum deteriorate the toughness of the heat-affected zone generated during field welding, reducing field weldability.

Chromium generally increases the hardenability of steel on direct quenching. It also generally improves corrosion and hydrogen assisted cracking resistance. As with molybdenum, excessive chromium, i.e., in excess of about 1.0 weight percent, tends to cause cold cracking after field welding, and tends to deteriorate the toughness of the steel and its HAZ, so preferably a maximum of about 1.0 weight percent is imposed.

Nitrogen suppresses the coarsening of austenite grains during slab reheating and in the heat-affected zone of welds by forming titanium nitride. Therefore, nitrogen contributes to the improvement of the low temperature toughness of both the base metal and heat-affected zone of welds. The minimum nitrogen content for this purpose is about 0.001 weight percent. The upper limit is preferably held at about 0.006 weight percent because excessive nitrogen increases the incidence of slab surface defects and reduces the effective hardenability of boron. Also, the presence of free nitrogen causes deterioration in the toughness of the heat-affected zone of welds.

Calcium and Rare Earth Metals (REM) generally control the shape of the manganese sulfide (MnS) inclusions and improve the low temperature toughness (e.g., the impact energy in the Charpy test). At least about 0.001 wt % Ca or about 0.001 wt % REM is desirable to control the shape of the sulfide. However, if the calcium content exceeds about 0.006 wt % or if the REM content exceeds about 0.02 wt %, large quantities of CaO—CaS (a form of calcium oxide—calcium sulfide) or REM-CaS (a form of rare earth metal—calcium sulfide) can be formed and converted to large clusters and large inclusions, which not only spoil the cleanness of the steel but also exert adverse influences on field weldability. Preferably the calcium concentration is limited to about 0.006 wt % and the REM concentration is limited to about 0.02 wt %. In ultra-high strength linepipe steels, reduction in the sulfur content to below about 0.001 wt % and reduction in the oxygen content to below about 0.003 wt %, preferably below about 0.002 wt %, while keeping the ESSP value preferably greater than about 0.5 and less than about 10, where ESSP is an index related to shape-controlling of sulfide inclusions in steel and is defined by the relationship: ESSP=(wt % Ca)[1–124(wt % O)]/1.25 (wt % S), can be particularly effective in improving both toughness and weldability.

Magnesium generally forms finely dispersed oxide particles, which can suppress coarsening of the grains and/or promote the formation of intragranular ferrite in the HAZ and, thereby, improve the HAZ toughness. At least about 0.0001 wt % Mg is desirable for the addition of Mg to be effective. However, if the Mg content exceeds about 0.006 wt %, coarse oxides are formed and the toughness of the HAZ is deteriorated.

Boron in small additions, from about 0.0005 wt % to about 0.0020 wt % (5 ppm–20 ppm), to low carbon steels (carbon contents less than about 0.3 wt %) can dramatically improve the hardenability of such steels by promoting the formation of the potent strengthening constituents, bainite or martensite, while retarding the formation of the softer ferrite and pearlite constituents during the cooling of the steel from high to ambient temperatures. Boron in excess of about 0.002 wt % can promote the formation of embrittling particles of $Fe_{23}(C,B)_6$ (a form of iron borocarbide). Therefore an upper limit of about 0.0020 wt % boron is preferred. A boron concentration between about 0.0005 wt % and about 0.0020 wt % (5 ppm–20 ppm) is desirable to obtain the maximum effect on hardenability. In view of the foregoing, boron can be used as an alternative to expensive alloy additions to promote microstructural uniformity throughout the thickness of steel plates. Boron also augments the effectiveness of both molybdenum and niobium in increasing the hardenability of the steel. Boron additions, therefore, allow the use of low Ceq steel compositions to produce high base plate strengths. Also, boron added to steels offers the potential of combining high strength with excellent weldability and cold cracking resistance. Boron can also enhance grain boundary strength and hence, resistance to hydrogen assisted intergranular cracking.

A first goal of the thermomechanical treatment of this invention, as illustrated schematically in FIG. 1, is achieving a microstructure comprising predominantly fine-grained lower bainite, fine-grained lath martensite, or mixtures thereof, transformed from substantially unrecrystallized austenite grains, and preferably also comprising a fine dispersion of cementite. The lower bainite and lath martensite constituents may be additionally hardened by even more finely dispersed precipitates of $Mo_2C$, V(C,N) and Nb(C,N), or mixtures thereof, and, in some instances, may contain boron. The fine-scale microstructure of the fine-grained lower bainite, fine-grained lath martensite, and mixtures thereof, provides the material with high strength and good low temperature toughness. To obtain the desired microstructure, the heated austenite grains in the steel slabs are first made fine in size, and second, deformed and flattened so that the through thickness dimension of the austenite grains is yet smaller, e.g., preferably less than about 5–20 microns and third, these flattened austenite grains are filled with a high density of dislocations and shear bands. These interfaces limit the growth of the transformation phases (i.e., the lower bainite and lath martensite) when the steel plate is cooled after the completion of hot rolling. The second goal is to retain sufficient Mo, V, and Nb, substantially in solid solution, after the plate is cooled to the Quench Stop Temperature, so that the Mo, V, and Nb are available to be precipitated as $Mo_2C$, Nb(C,N), and V(C,N) during the bainite transformation or during the welding thermal cycles to enhance and preserve the strength of the steel. The reheating temperature for the steel slab before hot rolling should be sufficiently high to maximize solution of the V, Nb, and Mo, while preventing the dissolution of the TiN particles that formed during the continuous casting of the steel, and serve to prevent coarsening of the austenite grains prior to hot-rolling. To achieve both these goals for the steel compositions of the present invention, the reheating temperature before hot-rolling should be at least about 1000° C. (1832° F.) and not greater than about 1250° C. (2282° F.). The slab is preferably reheated by a suitable means for raising the temperature of substantially the entire slab, preferably the entire slab, to the desired reheating temperature, e.g., by placing the slab in a furnace for a period of time. The specific reheating temperature that should be used for any steel composition within the range of the present invention may be readily determined by a person skilled in the art, either by experiment or by calculation using suitable models. Additionally, the furnace temperature and reheating time necessary to raise the temperature of substantially the entire slab, preferably the entire slab, to the desired reheating temperature may be readily determined by a person skilled in the art by reference to standard industry publications.

For any steel composition within the range of the present invention, the temperature that defines the boundary between the recrystallization range and non-recrystallization range, the $T_{nr}$ temperature, depends on the chemistry of the steel, and more particularly, on the reheating temperature before rolling, the carbon concentration, the niobium concentration and the amount of reduction given in the rolling passes. Persons skilled in the art may determine this temperature for each steel composition either by experiment or by model calculation.

Except for the reheating temperature, which applies to substantially the entire slab, subsequent temperatures referenced in describing the processing method of this invention are temperatures measured at the surface of the steel. The surface temperature of steel can be measured by use of an optical pyrometer, for example, or by any other device suitable for measuring the surface temperature of steel. The quenching (cooling) rates referred to herein are those at the center, or substantially at the center, of the plate thickness and the Quench Stop Temperature (QST) is the highest, or substantially the highest, temperature reached at the surface of the plate, after quenching is stopped, because of heat transmitted from the mid-thickness of the plate. The required temperature and flow rate of the quenching fluid to accomplish the desired accelerated cooling rate may be determined by one skilled in the art by reference to standard industry publications.

The hot-rolling conditions of the current invention, in addition to making the austenite grains fine in size, provide an increase in the dislocation density through the formation of deformation bands in the austenite grains, thereby leading to further refinement of the microstructure by limiting the size of the transformation products, i.e., the fine-grained lower bainite and the fine-grained lath martensite, during the cooling after the rolling is finished. If the rolling reduction in the recrystallization temperature range is decreased below the range disclosed herein while the rolling reduction in the non-recrystallization temperature range is increased above the range disclosed herein, the austenite grains will generally be insufficiently fine in size resulting in coarse austenite grains, thereby reducing both strength and toughness of the steel and causing higher hydrogen assisted cracking susceptibility. On the other hand, if the rolling reduction in the recrystallization temperature range is increased above the range disclosed herein while the rolling reduction in the non-recrystallization temperature range is decreased below the range disclosed herein, formation of deformation bands and dislocation substructures in the austenite grains can become inadequate for providing sufficient refinement of the transformation products when the steel is cooled after the rolling is finished.

After finish rolling, the steel is subjected to quenching from a temperature preferably no lower than about the $Ar_3$ transformation point and terminating at a temperature no higher than the $Ar_1$ transformation point, i.e., the temperature at which transformation of austenite to ferrite or to ferrite plus cementite is completed during cooling, preferably no higher than about 550° C. (1022° F.), and more preferably no higher than about 500° C. (932° F.). Water quenching is generally utilized; however any suitable fluid may be used to perform the quenching. Extended air cooling between rolling and quenching is generally not employed, according to this invention, since it interrupts the normal flow of material through the rolling and cooling process in a typical steel mill. However, it has been determined that, by interrupting the quench cycle in an appropriate range of temperatures and then allowing the quenched steel to air cool at the ambient temperature to its finished condition, particularly advantageous microstructural constituents are obtained without interruption of the rolling process and, thus, with little impact on the productivity of the rolling mill.

The hot-rolled and quenched steel plate is thus subjected to a final air cooling treatment which is commenced at a temperature that is no higher than the $Ar_1$ transformation point, preferably no higher than about 550° C. (1022° F.), and more preferably no higher than about 500° C. (932° F.). This final cooling treatment is conducted for the purposes of improving the toughness of the steel by allowing sufficient precipitation substantially uniformly throughout the fine-grained lower bainite and fine-grained lath martensite microstructure of finely dispersed cementite particles. Additionally, depending on the Quench Stop Temperature and the steel composition, even more finely dispersed $Mo_2C$, Nb(C,N), and V(C,N) precipitates may be formed, which can increase strength.

A steel plate produced by means of the described process exhibits high strength and high toughness with high uniformity of microstructure in the through thickness direction of the plate, in spite of the relatively low carbon concentration. For example, such a steel plate generally exhibits a yield strength of at least about 830 MPa (120 ksi), a tensile strength of at least about 900 MPa (130 ksi), and a toughness (measured at −40° C. (−40° F.), e.g., $vE_{-40}$) of at least about 120 joules (90 ft-lbs), which are properties suitable for linepipe applications. In addition, the tendency for heat-affected zone (HAZ) softening is reduced by the presence of, and additional formation during welding of, V(C,N) and Nb(C,N) precipitates. Furthermore, the sensitivity of the steel to hydrogen assisted cracking is remarkably reduced.

The HAZ in steel develops during the welding-induced thermal cycle and may extend for about 2–5 mm (0.08–0.2 inch) from the welding fusion line. In the HAZ a temperature gradient forms, e.g., from about 1400° C. to about 700° C. (2552° F.–1292° F.), which encompasses an area in which the following softening phenomena generally occur, from lower to higher temperature: softening by high temperature tempering reaction, and softening by austenization and slow cooling. At lower temperatures, around 700° C. (1292° F.), vanadium and niobium and their carbides or carbonitrides are present to prevent or substantially minimize the softening by retaining the high dislocation density and substructures; while at higher temperatures, around 850° C.–950° C. (1562° F.–1742° F.), additional vanadium and niobium carbides or carbonitride precipitates form and minimize the softening. The net effect during the welding-induced thermal cycle is that the loss of strength in the HAZ is less than about 10%, preferably less than about 5%, relative to the strength of the base steel. That is, the strength of the HAZ is at least about 90% of the strength of the base metal, preferably at least about 95% of the strength of the base metal. Maintaining strength in the HAZ is primarily due to a total vanadium and niobium concentration of greater than about 0.06 wt %, and preferably each of vanadium and niobium are present in the steel in concentrations of greater than about 0.03 wt %.

As is well known in the art, linepipe is formed from plate by the well-known U-O-E process in which: Plate is formed into a U-shape ("U"), then formed into an O-shape ("O"), and the O shape, after seam welding, is expanded about 1% ("E"). The forming and expansion with their concomitant work hardening effects leads to an increased strength of the linepipe.

The following examples serve to illustrate the invention described above.

Preferred Embodiments of IDQ Processing

According to the present invention, the preferred microstructure is comprised of predominantly fine-grained lower bainite, fine-grained lath martensite, or mixtures thereof. Specifically, for the highest combinations of strength and toughness and for HAZ softening resistance, the more preferable microstructure is comprised of predominantly fine-grained lower bainite strengthened with, in addition to cementite particles, fine and stable alloy carbides containing Mo, V, Nb or mixtures thereof. Specific examples of these microstructures are presented below.

Effect of Quench Stop Temperature on Microstructure

1) Boron Containing Steels with Sufficient Hardenability

Figure 2A:
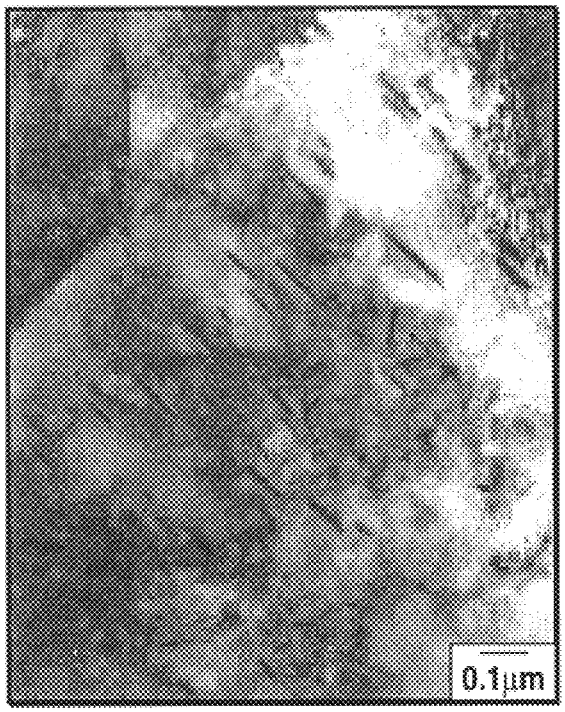
FIG. 2A and FIG. 2B are, respectively, bright and dark field transmission electron micrographs revealing the predominantly auto-tempered lath martensite microstructure of a steel processed with a Quench Stop Temperature of about 295° C. (563° F.); where
Figure 2B:
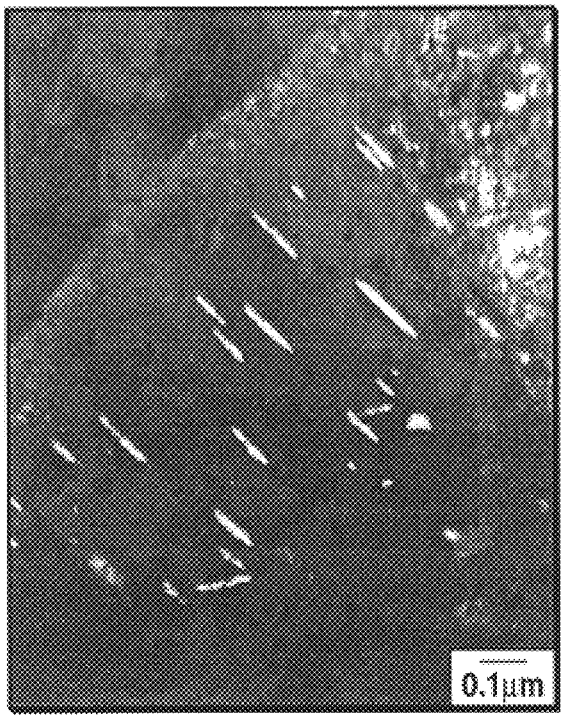
Figure 3:
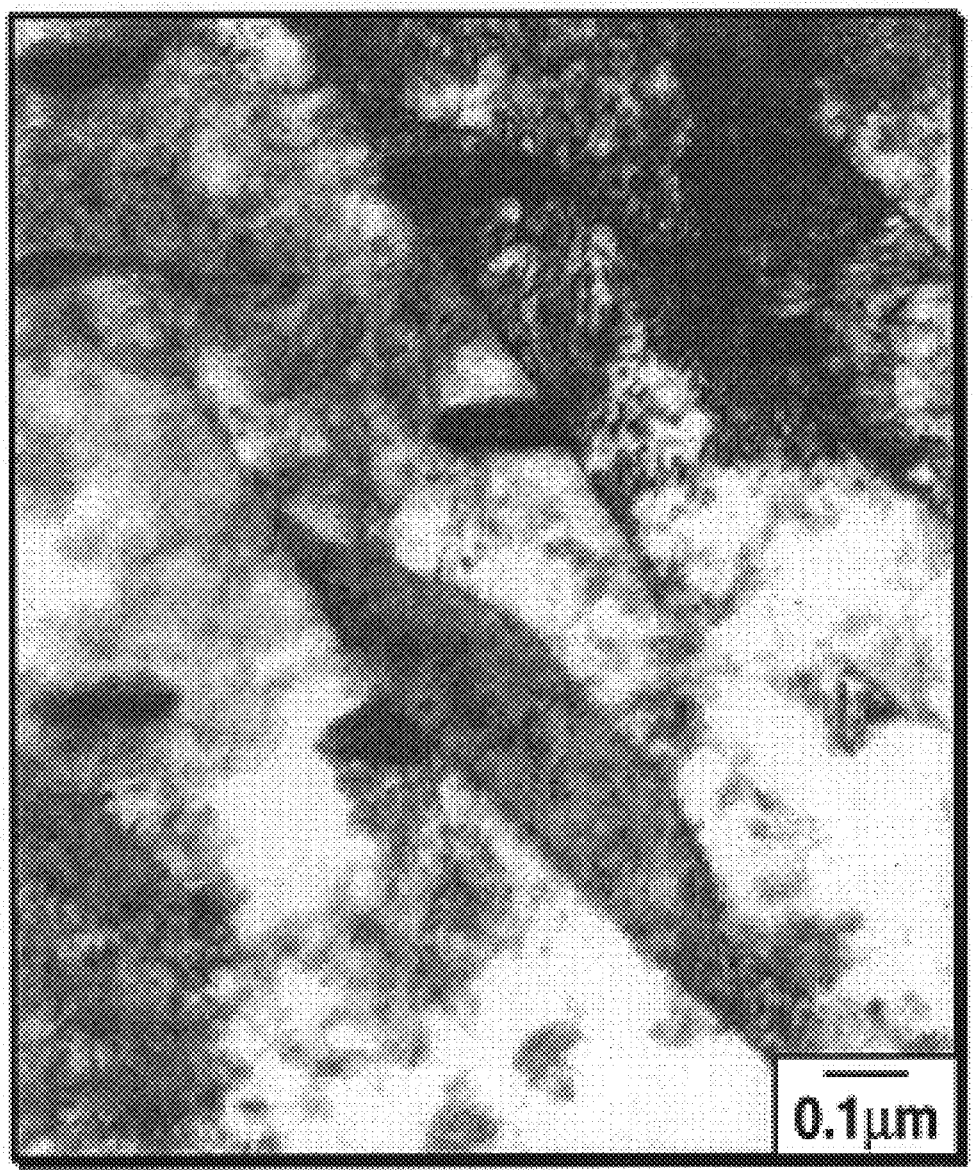
FIG. 3 is a bright-field transmission electron micrograph revealing the predominantly lower bainite microstructure of a steel processed with a Quench Stop Temperature of about 385° C. (725° F.).
Figure 4A:
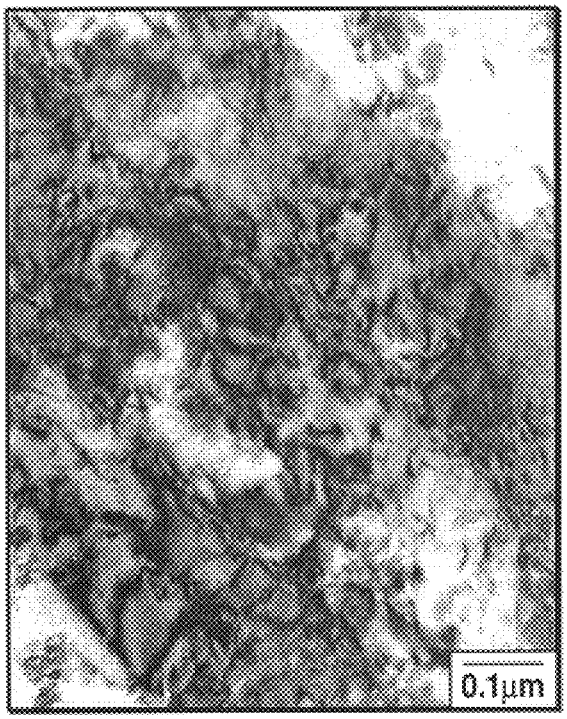
FIG. 4A and FIG. 4B arc, respectively, bright and dark field transmission electron micrographs of a steel processed with a QST of about 385° C. (725° F.), with FIG. 4A showing a predominantly lower bainite microstructure and FIG. 4B showing the presence of Mo, V, and Nb carbide particles having diameters less than about 10 nm.
Figure 4B:
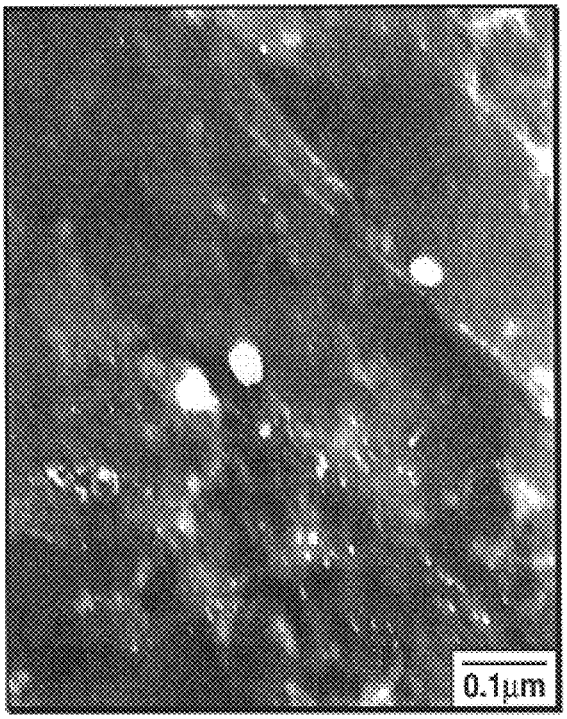
Figure 5:
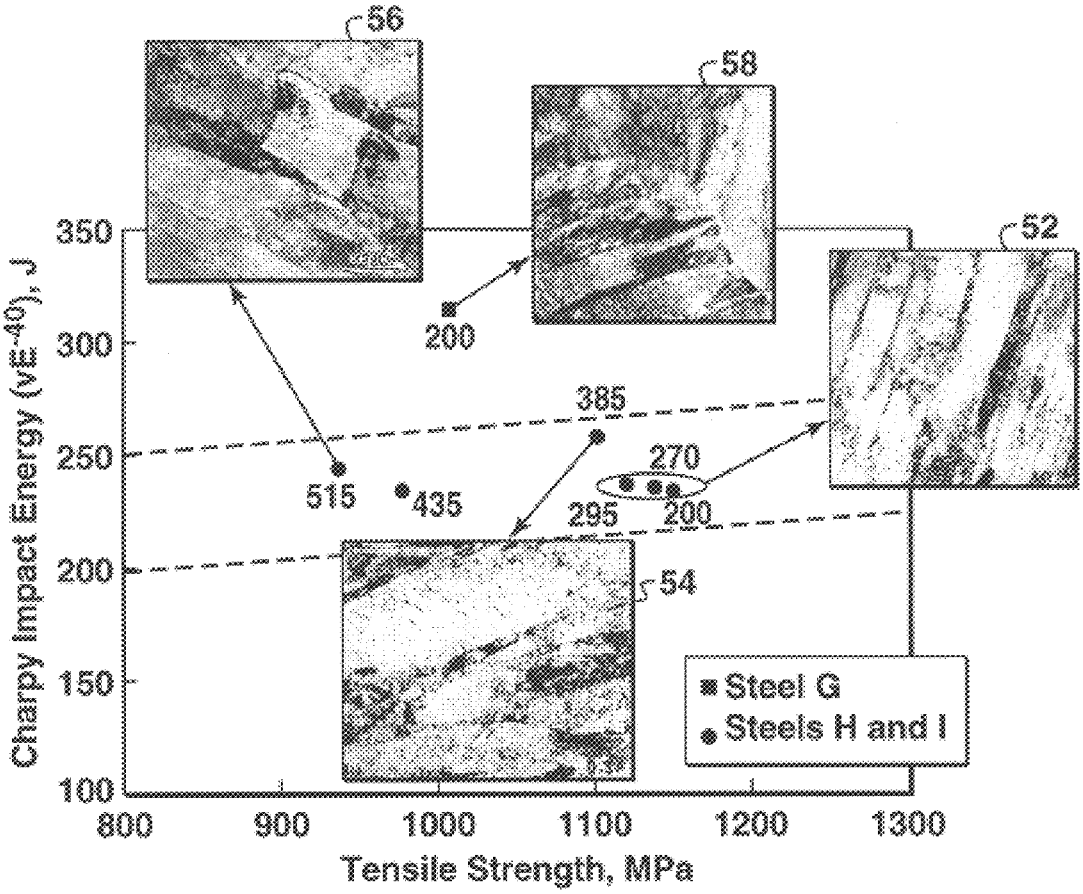
FIG. 5 is composite diagram, including a plot and transmission electron micrographs showing the effect of Quench Stop Temperature on the relative values of toughness and tensile strength for particular chemical formulations of boron steels identified in Table II herein as "H" and "I" (circles), and of a leaner boron steel identified in Table II herein as "G" (the square), all according to the present invention. Charpy Impact Energy at −40° C. (−40° F.), ($vE_{-40}$), joules is on the ordinate; tensile strength, in MPa, is on the abscissa.

The microstructure in IDQ processed steels with a quenching rate of about 20° C./sec to about 35° C./sec (36° F./sec–63° F./sec) is principally governed by the steel's hardenability as determined by compositional parameters such as carbon equivalent (Ceq) and the Quench Stop Temperature (QST). Boron steels with sufficient hardenability for steel plate having the preferred thickness for steel plates of this invention, viz., with Ceq greater than about 0.45 and less than about 0.7, are particularly suited to IDQ processing by providing an expanded processing window for formation of desirable microstructures (preferably, predominantly fine-grained lower bainite) and mechanical properties. The QST for these steels can be in the very wide range, preferably from about 550° C. to about 150° C. (1022° F.–302° F.), and yet produce the desired microstructure and properties. When these steels are IDQ processed with a low QST, viz., about 200° C. (392° F.), the microstructure is predominantly auto-tempered lath martensite. As the QST is increased to about 270° C. (518° F.), the microstructure is little changed from that with a QST of about 200° C. (392° F.) except for a slight coarsening of the auto-tempered cementite precipitates. The microstructure of the sample processed with a QST of about 295° C. (563° F.) revealed a mixture of lath martensite (major fraction) and lower bainite. However, the lath martensite shows significant auto-tempering, revealing well-developed, auto-tempered cementite precipitates. Referring now to FIG. 5, the microstructure of the aforementioned steels, processed with QSTs of about 200° C. (392° F.), about 270° C. (518° F.), and about 295° C. (563° F.), is represented by micrograph 52 of FIG. 5. Referring again to FIGS. 2A and 2B, FIGS. 2A and 2B show bright and dark field micrographs revealing the extensive cementite particles at QST of about 295° C. (563° F.). These features in lath martensite can lead to some lowering of the yield strength; however the strength of the steel shown in FIGS. 2A and 2B is still adequate for linepipe application. Referring now to FIGS. 3 and 5, as the QST is increased, to a QST of about 385° C. (725° F.), the microstructure comprises predominantly lower bainite, as shown in FIG. 3 and in micrograph 54 of FIG. 5. The bright field transmission electron micrograph, FIG. 3, reveals the characteristic cementite precipitates in a lower bainite matrix. In the alloys of this example, the lower bainite microstructure is characterized by excellent stability during thermal exposure, resisting softening even in the fine-grained and sub-critical and inter-critical heat-affected zone (HAZ) of weldments. This may be explained by the presence of very fine alloy carbonitrides of the type containing Mo, V and Nb. FIGS. 4A and 4B, respectively, present bright-field and dark-field transmission electron micrographs revealing the presence of carbide particles with diameters less than about 10 nm. These fine carbide particles can provide significant increases in yield strength.

FIG. 5 presents a summary of the microstructure and property observations made with one of the boron steels with the preferred chemical embodiments. The numbers under each data point represent the QST, in degrees Celsius, used for that data point. In this particular steel, as the QST is increased beyond 500° C. (932° F.), for example to about 515° C. (959° F.), the predominant microstructural constituent then becomes upper bainite, as illustrated by micrograph 56 of FIG. 5. At the QST of about 515° C. (959° F.), a small but appreciable amount of ferrite is also produced, as is also illustrated by micrograph 56 of FIG. 5. The net result is that the strength is lowered substantially without commensurate benefit in toughness. It has been found in this example that a substantial amount of upper bainite and especially predominantly upper bainite microstructures should be avoided for good combinations of strength and toughness.

2. Boron Containing Steels with Lean Chemistry

When boron-containing steels with lean chemistry (Ceq less than about 0.5 and greater than about 0.3) are IDQ processed to steel plates having the preferred thickness for steel plates of this invention, the resulting microstructures may contain varying amounts of proeutectoidal and eutectoidal ferrite, which are much softer phases than lower bainite and lath martensite microstructures. To meet the strength targets of the present invention, the total amount of the soft phases should be less than about 40%. Within this limitation, ferrite-containing IDQ processed boron steels may offer some attractive toughness at high strength levels as shown in FIG. 5 for a leaner, boron containing steel with a QST of about 200° C. (392° F.). This steel is characterized by a mixture of ferrite and auto-tempered lath martensite, with the latter being the predominant phase in the sample, as illustrated by micrograph 58 of FIG. 5.

3. Essentially Boron-free Steels with Sufficient Hardenability

Figure 6:
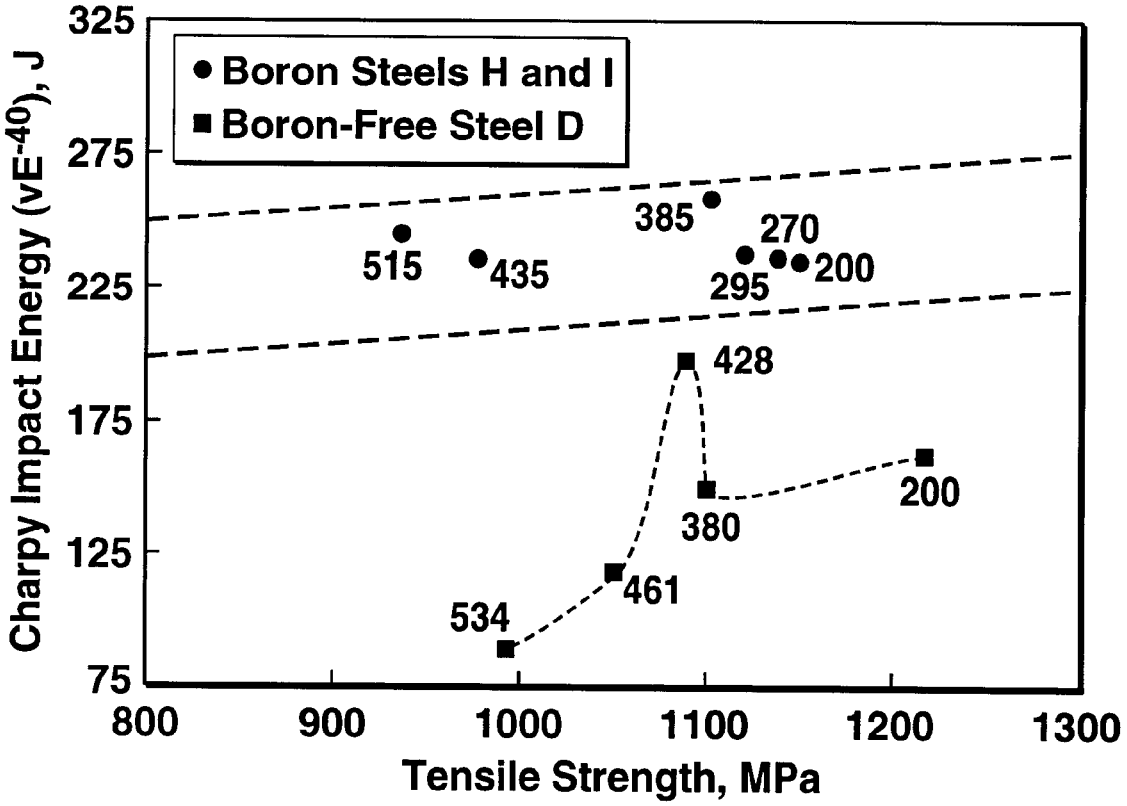
FIG. 6 is a plot showing the effect of Quench Stop Temperature on the relative values of toughness and tensile strength for particular chemical formulations of boron steels identified in Table II herein as "H" and "I" (circles), and of an essentially boron-free steel identified in Table II herein as "D" (the squares), all according to the present invention. Charpy Impact Energy at −40° C. (−40° F.), ($vE_{-40}$), in joules, is on the ordinate; tensile strength, in MPa, is on the abscissa.
Figure 7:
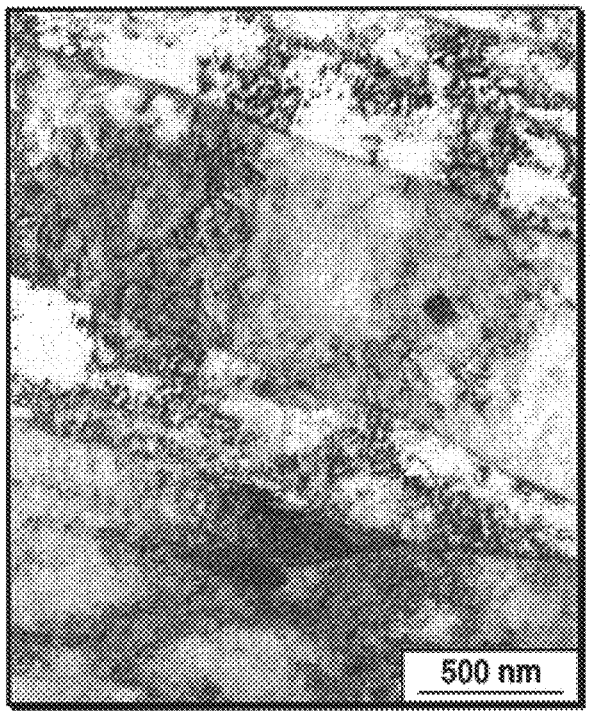
FIG. 7 is a bright-field transmission electron micrograph revealing dislocated lath martensite in sample steel "D" (according to Table II herein), which was IDQ processed with a Quench Stop Temperature of about 380° C. (716° F.).
Figure 8:
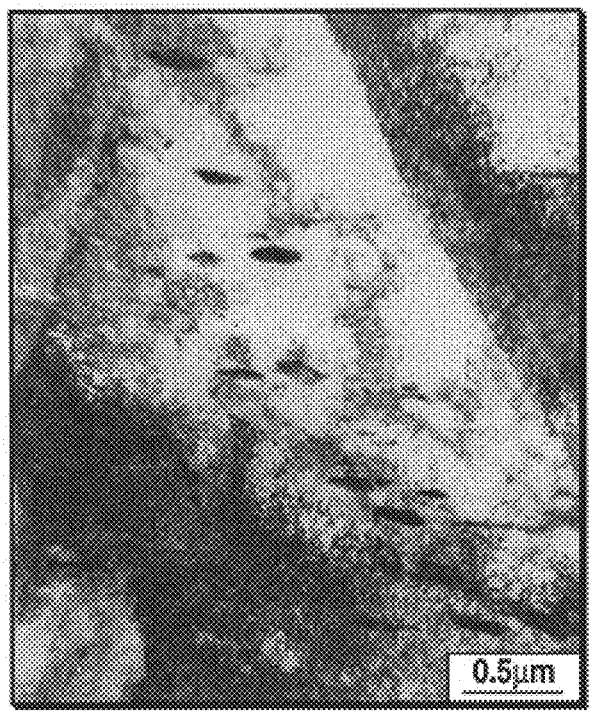
FIG. 8 is a bright-field transmission electron micrograph revealing a region of the predominantly lower bainite microstructure of sample steel "D" (according to Table II herein), which was IDQ processed with a Quench Stop Temperature of about 428° C. (802° F.). The unidirectionally aligned cementite platelets that are characteristic of lower bainite can be seen within the bainite laths.

The essentially boron-free steels of the current invention require a higher content of other alloying elements, compared to boron-containing steels, to achieve the same level of hardenability. Hence these essentially boron-free steels preferably are characterized by a high Ceq, preferably greater than about 0.5 and less than about 0.7, in order to be effectively processed to obtain acceptable microstructure and properties for steel plates having the preferred thickness for steel plates of this invention. FIG. 6 presents mechanical property measurements made on an essentially boron-free steel with the preferred chemical embodiments (squares), which are compared with the mechanical property measurements made on boron-containing steels of the current invention (circles). The numbers by each data point represent the QST (in ° C.) used for that data point. Microstructure property observations were made on the essentially boron-free steel. At a QST of 534° C., the microstructure was predominantly ferrite with precipitates plus upper bainite and twinned martensite. At a QST of 461° C., the microstructure was predominantly upper and lower bainite. At a QST of 428° C., the microstructure was predominantly lower bainite with precipitates. At the QSTs of 380° C. and 200° C., the microstructure was predominantly lath martensite with precipitates. It has been found in this example that a substantial amount of upper bainite and especially predominantly upper bainite microstructures should be avoided for good combinations of strength and toughness. Furthermore, very high QSTs should also be avoided since mixed microstructures of ferrite and twinned martensite do not provide good combinations of strength and toughness. When the essentially boron-free steels are IDQ processed with a QST of about 380° C. (716° F.), the microstructure is predominantly lath martensite as shown in FIG. 7. This bright field transmission electron micrograph reveals a fine, parallel lath structure with a high dislocation content whereby the high strength for this structure is derived. The microstructure is deemed desirable from the standpoint of high strength and toughness. It is notable, however, that the toughness is not as high as is achievable with the predominantly lower bainite microstructures obtained in boron-containing steels of this invention at equivalent IDQ Quench Stop Temperatures (QSTs) or, indeed, at QSTs as low as about 200° C. (392° F.). As the QST is increased to about 428° C. (802° F.), the microstructure changes rapidly from one consisting of predominantly lath martensite to one consisting of predominantly lower bainite. FIG. 8, the transmission electron micrograph of steel "D" (according to Table II herein) IDQ processed to a QST of 428° C. (802° F.), reveals the characteristic cementite precipitates in a lower bainite ferrite matrix. In the alloys of this example, the lower bainite microstructure is characterized by excellent stability during thermal exposure, resisting softening even in the fine grained and sub-critical and inter-critical heat-affected zone (HAZ) of weldments. This may be explained by the presence of very fine alloy carbonitrides of the type containing Mo, V and Nb.

Figure 9:
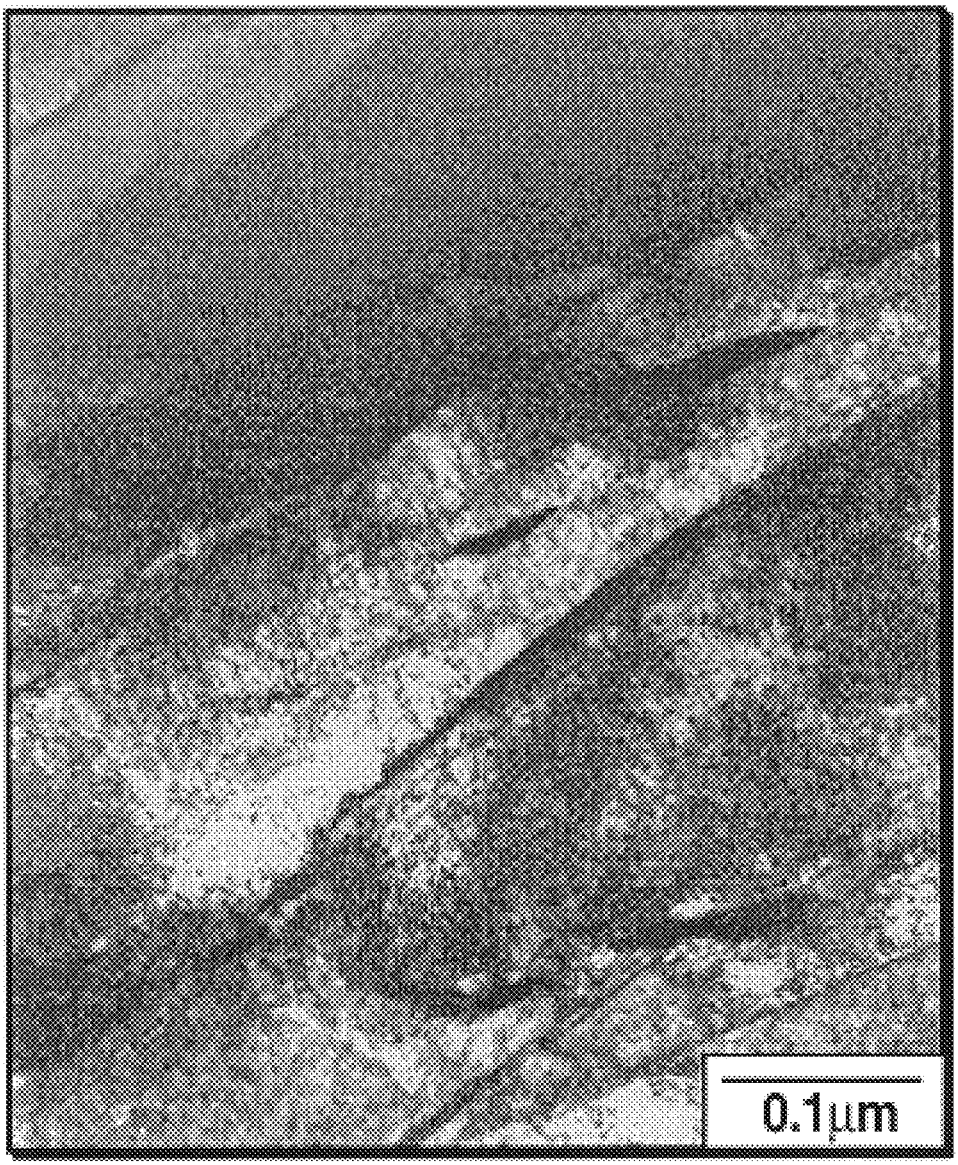
FIG. 9 is a bright-field transmission electron micrograph revealing upper bainite in sample steel "D" (according to Table II herein), which was IDQ processed with a Quench Stop Temperature of about 461° C. (862° F.).

When the QST temperature is raised to about 460° C. (860° F.), the microstructure of predominantly lower bainite is replaced by one consisting of a mixture of upper bainite and lower bainite. As expected, the higher QST results in a reduction of strength. This strength reduction is accompanied by a drop in toughness attributable to the presence of a significant volume fraction of upper bainite. The bright-field transmission electron micrograph, shown in FIG. 9, shows a region of example steel "D" (according to Table II herein), that was IDQ processed with a QST of about 461° C. (862° F.). The micrograph reveals upper bainite lath characterized by the presence of cementite platelets at the boundaries of the bainite ferrite laths.

Figure 10A:
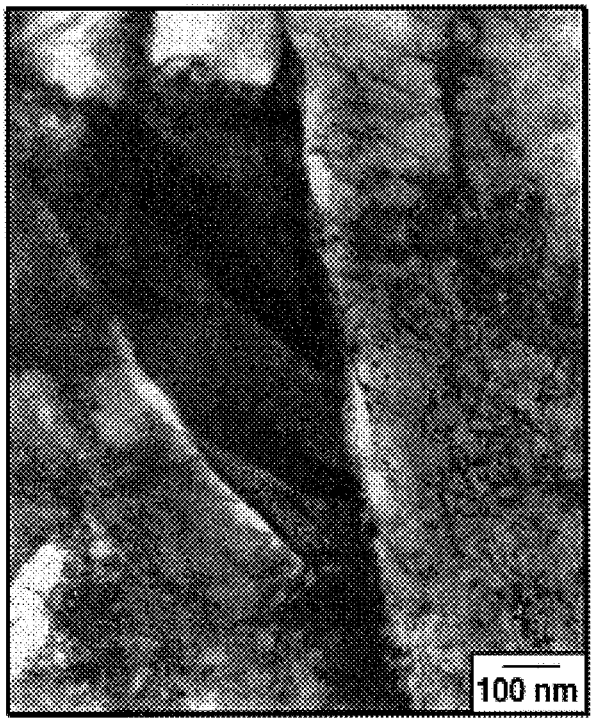
FIG. 10A is a bright-field transmission electron micrograph revealing a region of martensite (center) surrounded by ferrite in sample steel "D" (according to Table II herein), which was IDQ processed with a Quench Stop Temperature of about 534° C. (993° F.). Fine carbide precipitates can be seen within the ferrite in the region adjacent to the ferrite/martensite boundary.
Figure 10B:
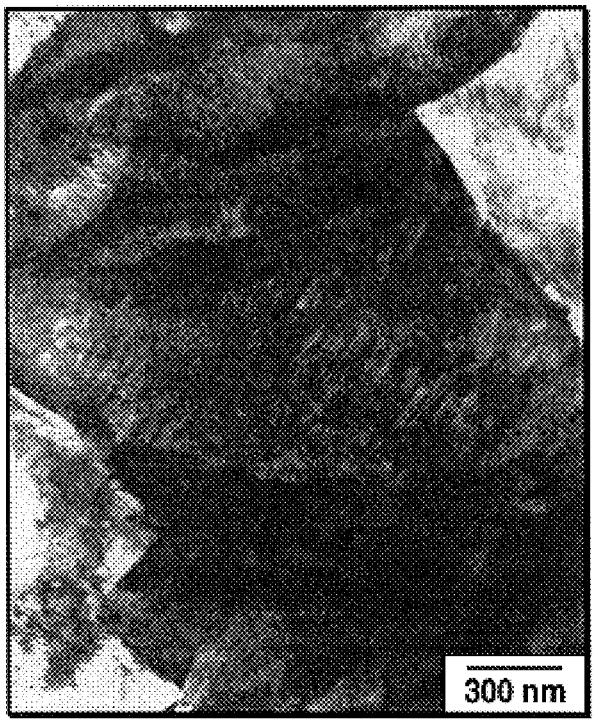
FIG. 10B is a bright-field transmission electron micrograph revealing high carbon, twinned martensite in sample steel "D" (according to Table II herein), which was IDQ processed with a Quench Stop Temperature of about 534° C. (993° F.).

At yet higher QSTS, e.g., 534° C. (993° F.), the microstructure consists of a mixture of precipitate containing ferrite and twinned martensite. The bright-field transmission electron micrographs, shown in FIGS. 10A and 10B, are taken from regions of example steel "D" (according to Table II herein) that was IDQ processed with a QST of about 534° C. (993° F.). In this specimen, an appreciable amount of precipitate-containing ferrite was produced along with brittle twinned martensite. The net result is that the strength is lowered substantially without commensurate benefit in toughness.

For acceptable properties of this invention, essentially boron-free steels offer a proper QST range, preferably from about 200° C. to about 450° C. (392° F.–842° F.), for producing the desired structure and properties. Below about 150° C. (302° F.), the lath martensite is too strong for optimum toughness, while above about 450° C. (842° F.), the steel, first, produces too much upper bainite and progressively higher amounts of ferrite, with deleterious precipitation, and ultimately twinned martensite, leading to poor toughness in these samples.

The microstructural features in these essentially boron-free steels result from the not so desirable continuous cooling transformation characteristics in these steels. In the absence of added boron, ferrite nucleation is not suppressed as effectively as is the case in boron-containing steels. As a result, at high QSTs, significant amounts of ferrite are formed initially during the transformation, causing the partitioning of carbon to the remaining austenite, which subsequently transforms to the high carbon twinned martensite. Secondly, in the absence of added boron in the steel, the transformation to upper bainite is similarly not suppressed, resulting in undesirable mixed upper and lower bainite microstructures that have inadequate toughness properties. Nevertheless, in instances where steel mills do not have the expertise to produce boron-containing steels consistently, the IDQ processing can still be effectively utilized to produce steels of exceptional strength and toughness, provided the guidelines stated above are employed in processing these steels, particularly with regard to the QST.

Steel slabs processed according to this invention preferably undergo proper reheating prior to rolling to induce the desired effects on microstructure.

Reheating serves the purpose of substantially dissolving, in the austenite, the carbides and carbonitrides of Mo, Nb and V so these elements can be re-precipitated later during steel processing in more desired forms, i.e., fine precipitation in austenite or the austenite transformation products before quenching as well as upon cooling and welding. In the present invention, reheating is effected at temperatures in the range of about 1000° C. (1832° F.) to about 1250° C. (2282° F.), and preferably from about 1050° C. to about 1150° C. (1922° F.–2102° F.). The alloy design and the thermomechanical processing have been geared to produce the following balance with regard to the strong carbonitride formers, specifically niobium and vanadium:

- about one third of these elements preferably precipitate in austenite prior to quenching
- about one third of these elements preferably precipitate in austenite transformation products upon cooling following quenching
- about one third of these elements are preferably retained in solid solution to be available for precipitation in the HAZ to ameliorate the normal softening observed in the steels having yield strength greater than 550 MPa (80 ksi).

The rolling schedule used in the production of the example steels is given in Table I.

TABLE I

| Pass | Thickness After Pass-mm (in) | Temperature-°C.(°F.) |
|---|---|---|
| 0 | 100(3.9) | 1240(2264) |
| 1 | 90(3.5) | — |
| 2 | 80(3.1) | — |
| 3 | 70(2.8) | 1080(1976) |
| 4 | 60(2.4) | 930(1706) |
| 5 | 45(1.8) | — |
| 6 | 30(1.2) | — |
| 7 | 20(0.8) | 827(1521) |

The steels were quenched from the finish rolling temperature to a Quench Stop Temperature at a cooling rate of 35° C./second (63° F./second) followed by an air cool to ambient temperature. This IDQ processing produced the desired microstructure comprising predominantly fine-grained lower bainite, fine-grained lath martensite, or mixtures thereof.

Referring again to FIG. 6, it can be seen that steel D (Table II), which is essentially free of boron (lower set of data points connected by dashed line), as well as the steels H and I (Table II) that contain a predetermined small amount of boron (upper set of data points between parallel lines), can be formulated and fabricated so as to produce a tensile strength in excess of 900 MPa (135 ksi) and a toughness in excess of 20joules (90 ft-lbs) at −40° C. (−40° F.), e.g., $vE_{-40}$ in excess of 120 joules (90 ft-lbs). In each instance, the resulting material is characterized by predominantly fine-grained lower bainite and/or fine-grained lath martensite. As indicated by the data point labeled "534" (representation of the Quench Stop Temperature in degrees Celsius employed for that sample), when the process parameters fall outside the limits of the method of this invention, the resulting microstructure (ferrite with precipitates plus upper bainite and/or twinned martensite or lath martensite) is not the desired microstructure of the steels of this invention, and the tensile strength or toughness, or both, fall below the desired ranges for linepipe applications.

Examples of steels formulated according to the present invention are shown in Table II. The steels identified as "A"–"D" are essentially boron-free steels while those identified as "E"–"I" contain added boron.

TABLE II

COMPOSITION OF EXPERIMENTAL STEELS

| Steel | Alloy Content (wt % or +ppm) | | | | | | | | | | | | | | |
|---|---|---|---|---|---|---|---|---|---|---|---|---|---|---|---|
| ID | C | Si | Mn | Ni | Cu | Cr | Mo | Nb | V | Ti | Al | B+ | N+ | P+ | S+ |
| A | 0.050 | 0.07 | 1.79 | 0.35 | — | 0.6 | 0.30 | 0.030 | 0.030 | 0.012 | 0.021 | — | 21 | 50 | 10 |
| B | 0.049 | 0.07 | 1.79 | 0.35 | — | 0.6 | 0.30 | 0.031 | 0.059 | 0.012 | 0.019 | — | 19 | 50 | 8 |

TABLE II-continued

COMPOSITION OF EXPERIMENTAL STEELS

| Steel | Alloy Content (wt % or +ppm) | | | | | | | | | | | | | | |
|---|---|---|---|---|---|---|---|---|---|---|---|---|---|---|---|
| ID | C | Si | Mn | Ni | Cu | Cr | Mo | Nb | V | Ti | Al | B+ | N+ | P+ | S+ |
| C | 0.071 | 0.07 | 1.79 | 0.35 | — | 0.6 | 0.30 | 0.030 | 0.059 | 0.012 | 0.019 | — | 19 | 50 | 8 |
| D | 0.072 | 0.25 | 1.97 | 0.33 | 0.4 | 0.6 | 0.46 | 0.032 | 0.052 | 0.015 | 0.018 | — | 40 | 50 | 16 |
| E | 0.049 | 0.07 | 1.62 | 0.35 | — | — | 0.20 | 0.030 | 0.060 | 0.015 | 0.020 | 8 | 27 | 50 | 6 |
| F | 0.049 | 0.07 | 1.80 | 0.35 | — | — | 0.20 | 0.030 | 0.060 | 0.015 | 0.020 | 8 | 25 | 50 | 8 |
| G | 0.069 | 0.07 | 1.81 | 0.35 | — | — | 0.20 | 0.032 | 0.062 | 0.018 | 0.020 | 8 | 31 | 50 | 7 |
| H | 0.072 | 0.07 | 1.91 | 0.35 | — | 0.29 | 0.30 | 0.031 | 0.059 | 0.015 | 0.019 | 10 | 25 | 50 | 9 |
| I | 0.070 | 0.09 | 1.95 | 0.35 | — | 0.30 | 0.30 | 0.030 | 0.059 | 0.014 | 0.020 | 9 | 16 | 50 | 10 |

Preferred Embodiment for Excellent Ultra-low Temperature Toughness (ULTT)

To achieve a steel plate according to the current invention with a tensile strength of greater than about 930 MPa (13 5 ksi) and having excellent ultra-low temperature toughness, the microstructure of the steel plate preferably comprises at least about 90 volume percent of a mixture of fine-grained lower bainite and fine-grained lath martensite. Preferably at least about ⅔, more preferably at least about ¾ of the mixture of fine-grained lower bainite and fine-grained lath martensite comprises fine-grained lower bainite transformed from unrecrystallized austenite having an average grain size of less than about 10 microns. Such fine-grained lower bainite, characterized by finely dispersed carbides within the grains, exhibits excellent ultra-low temperature toughness. The superior low temperature toughness of such fine-grained lower bainite, which is characterized by the fine facets on the fracture surface, can be attributed to the tortuosity of the fracture path in such microstructures. Auto-tempered, fine-grained lath martensite offers ultra-low temperature toughness similar to that of fine-grained lower bainite. Conversely, upper bainite that contains a large amount of the martensite-austenite (MA) constituent has inferior low temperature toughness. Generally, it is difficult to obtain ultra high strength with microstructures containing high percentages of ferrite and/or upper bainite. Such constituents lead to non-uniformity of the microstructure. Thus, while the remaining volume percent of the microstructure can comprise upper bainite, twinned martensite, and ferrite, or mixtures thereof, the formation of upper bainite is preferably minimized. Preferably, the microstructure of the steel plate comprises less than about 8 volume percent of martensite-austenite constituent.

To produce steel plates having excellent ultra-low temperature toughness according to this ULTT embodiment of the current invention, it is desirable to optimize the prior austenite microstructure, that is, the austenite microstructure that exists at or above the austenite to ferrite transformation temperature, i.e., the $Ar_3$ transformation point, in order to effectively refine the final microstructure of the steel. To achieve this goal, the prior austenite is conditioned as unrecrystallized austenite to promote formation of a grain size averaging less than about 10 microns. Such grain refinement of unrecrystallized austenite is particularly effective in improving the ultra-low temperature toughness of steels according to this ULTT embodiment. To obtain the desired ultra-low temperature toughness (for example, 50% vTrs of less than about −60° C. (−76° F.), preferably less than about −85° C. (−121° F.) and $vE_{-40}$ of greater than about 120 J (88 ft-lb), preferably greater than about 175 J (129 ft-lb)), the average grain size, d, of unrecrystallized austenite is preferably less than about 10 microns. The deformation bands and the twin boundaries, which act like austenite grain boundaries during the transformation, are treated as, and thus define, the austenite grain boundaries. Specifically, the overall length of a straight line drawn across the thickness of steel plate divided by the number of intersections between the line and the austenite grain boundaries, as defined above, is the average grain size, d. The austenite grain size, thus determined, has proved to have a very good correlation with ultra-low temperature toughness characteristics as measured, for example, by the Charpy V-notch impact test.

The following description of alloy composition and processing method for steels of this ULTT embodiment further defines the alloy composition and processing method described above for steels of the current invention.

For steels according to this ULTT embodiment, the P-Value, which is dependent on the composition of certain alloying elements in a steel, is descriptive of the hardenability of the steel, and is defined herein, is preferably established within the ranges discussed below in order to gain a balance between the desired strength and ultra-low temperature toughness. More particularly, the lower limits of P-Value ranges are set to obtain a tensile strength of at least about 930 MPa (135 ksi) and excellent ultra-low temperature toughness. The upper limits of P-Value ranges are set to obtain excellent field weldability and low temperature toughness in the heat-affected zone. The P-Value is further defined below and in the Glossary.

For essentially boron-free steels according to this ULTT embodiment, the P-Value is preferably greater than about 1.9 and less than about 2.8. For essentially boron-free steels the P-Value is defined as: P-Value=2.7C+0.4Si+Mn+0.8Cr+0.45(Ni+Cu)+Mo+V−1, where the alloying elements C, Si, Mn, Cr, Ni, Cu, Mo and V are expressed in weight percent.

For boron-containing steels according to this ULTT embodiment, the P-Value is preferably greater than about 2.5 and less than about 3.5. For boron-containing steels the P-Value is defined as: P-Value=2.7C+0.4Si+Mn+0.8Cr+0.45(Ni+Cu)+2Mo+V, where the alloying elements C, Si, Mn, Cr, Ni, Cu, Mo and V are expressed in weight percent.

Regarding further definition for alloying elements of steels according to this ULTT embodiment, the carbon content is preferably at least about 0.05 weight percent in order to obtain the desired strength and fine-grained lower bainite and fine-grained lath martensite microstructure through thickness.

Further, for purposes of this ULTT embodiment, the lower limit of manganese content is preferably about 1.7 weight percent. Manganese is essential for obtaining the desired microstructures for this ULTT embodiment that give rise to a good balance between strength and low temperature toughness.

The impact of molybdenum on the hardenability of steel is particularly pronounced in boron-containing steels of this ULTT embodiment. Referring to the P-Value definitions, the multiplying factor for molybdenum in the P-Value takes a value of 1 in essentially boron-free steels and a value of 2 in boron-containing steels. When molybdenum is added together with niobium, molybdenum augments the suppression of the austenite recrystallization during controlled rolling and, thereby, contributes to the refinement of austenite microstructure. To achieve these desired effects in steels according to this ULTT embodiment, the amount of molybdenum added to essentially boron-free steels is preferably at least about 0.35 weight percent and the amount of molybdenum added to boron-containing steels is preferably at least about 0.25 weight percent.

Very small quantities of boron can greatly increase the hardenability of steel and promote the formation of the lower bainite microstructure by suppressing the formation of upper bainite. The amount of boron for increasing the hardenability of steels according to this ULTT embodiment is preferably at least about 0.0006 weight percent (6 ppm) and, in accordance with all steels of the current invention, is preferably no greater than about 0.0020 weight percent (20 ppm). The presence of boron in the disclosed range is a very efficient hardenability agent. This is demonstrated by the effect of the presence of boron on the hardenability parameter, P-Value. Boron, in the effective range, increases the P-Value by 1, i.e., it increases hardenability. Boron also augments the effectiveness of both molybdenum and niobium in increasing the hardenability of the steel.

In steels of this ULTT embodiment, the contents of phosphorus and sulfur, which are generally present in steel as impurities, are preferably less than about 0.015 weight percent and about 0.003 weight percent, respectively. This preference arises from the need to maximize improvement in the low temperature toughness of the base metal and heat-affected zone of welds. Limiting phosphorus content as described contributes to the improvement of low temperature toughness by decreasing centerline segregation in continuously cast slabs and preventing intergranular fracture. Limiting sulfur content as described improves the ductility and toughness of steel by decreasing the number and size of manganese sulfide inclusions that are elongated during hot rolling. Vanadium, copper, or chromium may be added to steels of this ULTT embodiment, but are not required. When vanadium, copper, or chromium are added to steels of this ULTT embodiment, lower limits of about 0.01, 0.1, or 0.1 weight percent, respectively, are preferred, because these arc the minimum amounts of the individual elements necessary to provide a discernible influence on the steel properties. As discussed in regard to steels of this invention in general, the preferable upper limit for vanadium content is about 0.10 weight percent, more preferably about 0.08 weight percent. An upper limit of about 0.8 weight percent is preferred for both copper and chromium in this ULTT embodiment, because either copper or chromium contents in excess thereof would tend to significantly deteriorate field weldability and the toughness of the heat-affected zone.

Even steels having the chemical compositions defined above will not produce the desired properties unless they are processed under appropriate conditions to produce the desired microstructures of this ULTT embodiment.

According to this ULTT embodiment of the current invention, a steel slab or ingot of the desired chemistry is reheated to a temperature preferably between about 1050° C. and about 1250° C. (1922° F.–2282° F.). It is then hot rolled in accordance with the method of the current invention. Specifically, for this ULTT embodiment, hot rolling is performed preferably with a finish rolling temperature greater than about 700° C. (1292° F.); and heavy rolling, i.e., a reduction in thickness of more than about 50 percent, occurs preferably between about 950° C. (1742° F.) and about 700° C. (1292° F.). More specifically, the reheated slab or ingot is hot rolled to a reduction of preferably at least about 20% but less than about 50% (in thickness) to form plate in one or more passes within a first temperature range in which austenite recrystallizes, and then is hot rolled to a reduction of greater than about 50% (in thickness) in one or more passes within a second temperature range, somewhat lower than the first temperature range, at which austenite does not recrystallize and above the $Ar_3$ transformation point, wherein the second temperature range is preferably about 950° C. to about 700° C. (1742° F.–1292° F.). After finish rolling, for both boron-containing and essentially boron-free steels according to this ULTT embodiment, the steel plate is quenched to a desired Quench Stop Temperature between about 450° C. (842° F.) and about 200° C. (392° F.) at a cooling rate of at least about 10° C./second (18° F./second), preferably at least about 20° C./second (36° F./second). Quenching is stopped and the steel plate is allowed to air cool to ambient temperature, so as to facilitate completion of transformation of the steel plate to at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns.

To further explain, the steel is reheated preferably to at least about 1050° C. (1922° F.) so that substantially all of the individual elements are taken into solid solution and so that the steel remains within the desired temperature range during rolling. The steel is reheated to a temperature preferably no greater than about 1250° C. (2282° F.) to avoid coarsening of the austenite grains to such an extent that subsequent refinement by rolling is not sufficiently effective. The steel is reheated preferably by suitable means for raising the temperature of the entire steel slab or ingot to the desired reheating temperature, e.g., by placing the steel slab or ingot in a furnace for a period of time. The reheated steel is rolled preferably under such conditions that the austenite grains, coarsened by reheating, recrystallize to finer grains during the higher temperature rolling as discussed above. To obtain ultra-refinement of the austenite grain structure in the through thickness direction as desired, heavy rolling is preferably carried out within the second temperature range where austenite does not recrystallize. Generally, for the steels of this ULTT embodiment, which contain more than about 0.01 weight percent of both niobium and molybdenum, the upper limit of this non-recrystallizing temperature range, i.e., the $T_{nr}$ temperature, is about 950° C. (1742° F.). Within this non-recrystallizing temperature range a reduction in thickness of the steel during hot rolling of more than about 50 percent is preferred to produce the desired microstructural refinement. Rolling is preferably completed above the temperature at which austenite begins to transform to ferrite during cooling, i.e., the $Ar_3$ transformation point. Furthermore, for the steels of this ULTT embodiment, hot rolling is preferably completed at a temperature of about 700° C. (1292° F.) or greater. Higher toughness at low temperatures can be obtained by completing the rolling at as low a temperature as possible while still above both about 700° C. (1292° F.) and the $Ar_3$ transformation point. In addition, for the steels of this ULTT embodiment, hot rolling is preferably completed at a temperature of below about 850° C. (1 562° F.). To obtain the desired fine-grained lower bainite microstructure, the rolled steel is cooled, for example by water-quenching, preferably to a temperature between about 450° C. (842° F.) and about 200° C. (392° F.), where lower bainite and austenite transformations reach completion, at a quenching (cooling) rate of greater than about 10° C./second (18° F./second), preferably greater than about 20° C./second (36° F./second), so that essentially no ferrite is formed. The cooling rate of greater than about 10° C./second (18° F./second), preferably greater than about 20° C./second (36° F./second), corresponds to the critical cooling rate to substantially exclude the formation of ferrite/upper bainite and allow the steel to transform to predominantly lower bainite/lath martensite in steels prepared with low alloy additions and with P-Values close to the lower limit of the ranges specified for this ULTT embodiment. With higher cooling rates, slight improvement in toughness is possible. Since the upper limit of the cooling rate is defined by thermal conductivity, no upper limit is specified. If cooling by quenching is stopped above about 450° C. (842° F.), upper bainite will tend to form, which can be detrimental to low temperature toughness. By contrast, if such cooling is continued to below about 200° C. (392° F.), a thermally-unstable martensite microstructure will tend to form, which can result in a decrease in low temperature toughness. Furthermore, the presence of thermally-unstable martensite tends to increase the degree of softening in the heat-affected zone. Thus, the Quench Stop Temperature (QST) is preferably limited to between about 450° C. (842° F.) and about 200° C. (392° F.).

Examples of steels prepared according to this ULTT embodiment are given below. Materials of various compositions were prepared as ingots, about 50 kg (110 lbs) in weight and about 100 mm (3.94 inches) in thickness, by laboratory melting and as slab, about 240 mm (9.45 inches) in thickness, by a combination of LD-converter and continuous casting, known processes of steel making. The ingots or slabs were rolled into plates under various conditions, according to the method described herein. The properties and microstructures of the plates, ranging in thickness from about 15 mm (0.6 inch) to about 25 mm (1 inch), were investigated. The mechanical properties of the steel samples, that is, yield strength (YS), tensile strength (TS), impact energy at −40° C. (−40° F.) ($vE_{-40}$), and 50% vTrs by the Charpy V-notch impact test, were determined in a direction perpendicular to the rolling direction. The toughness in the heat-affected zone, impact energy at −20° C. (−4° F.) ($vE_{-20}$), was evaluated using the heat-affected zone reproduced by a weld heat cycle simulator, with a maximum heating temperature of about 1400° C. (2552° F.) and a cooling time of about 25 seconds between about 800° C. (1472° F.) and about 500° C. (932° F.), i.e., with a cooling rate of about 12° C./second (22° F./second). Field weldability was evaluated on the basis of the minimum preheating temperature required for the prevention of the cold cracking of the heat-affected zone, as determined by the Y-slit weld cracking test (a known test for determining preheating temperature), according to the Japanese Industrial Standard, JIS G 3158. Welding was performed by the gas metal arc welding method using an electrode with a tensile strength of about 1000 MPa (145 ksi), a heat input of about 0.3 kJ/mm and the weld metal containing 3 cc of hydrogen per 100 g of metal.

Table III, and Tables IV (metric (S.I.)units) and V (English units), show data for the examples of this ULTT embodiment of the current invention, together with data for some steels outside the scope of this ULTT embodiment, prepared for the purpose of comparison. The steel plates according to this ULTT embodiment have excellent balance among strength, toughness at low temperatures, and field weldability.

TABLE III

COMPOSITION OF EXAMPLE AND COMPARISON STEELS

| Steel | Alloy Content (wt % or +ppm) | | | | | | | | | | | | | | | | |
|---|---|---|---|---|---|---|---|---|---|---|---|---|---|---|---|---|---|
| ID | C | Si | Mn | Ni | Cu | Cr | Mo | Nb | V | Ti | Al | B+ | N+ | P+ | S+ | Others | P-Value |
| 1 | 0.07 | 0.12 | 2.0 | 0.52 | — | — | 0.48 | 0.02 | 0.03 | 0.012 | 0.030 | <3 | 30 | 110 | 10 | Ca:0.002 | 1.951 |
| 2 | 0.06 | 0.23 | 1.8 | 0.35 | — | 0.6 | 0.40 | 0.03 | 0.06 | 0.015 | 0.020 | <3 | 30 | 90 | 20 | Ca:0.002 | 2.1515 |
| 3 | 0.08 | 0.30 | 1.9 | 0.31 | 0.45 | 0.58 | 0.45 | 0.03 | 0.03 | 0.014 | 0.020 | <3 | 40 | 70 | 30 | — | 2.522 |
| 4 | 0.07 | 0.15 | 1.9 | 0.55 | 0.28 | 0.32 | 0.39 | 0.04 | — | 0.016 | 0.040 | <3 | 30 | 50 | 16 | REM:0.004 | 2.1685 |
| 5 | 0.07 | 0.08 | 1.9 | 0.45 | — | — | 0.34 | 0.03 | — | 0.020 | 0.030 | 11 | 30 | 80 | 20 | — | 3.0035 |
| 6 | 0.06 | 0.07 | 1.8 | 0.36 | — | 0.23 | 0.30 | 0.03 | 0.06 | 0.016 | 0.020 | 8 | 20 | 90 | 20 | Mg:0.002 | 2.936 |
| 7 | 0.08 | 0.16 | 1.7 | 0.30 | — | 0.25 | 0.28 | 0.02 | 0.04 | 0.022 | 0.010 | 16 | 20 | 130 | 10 | — | 2.875 |
| 8 | 0.05 | 0.11 | 1.9 | 0.44 | — | 0.35 | 0.34 | 0.03 | — | 0.018 | 0.020 | 13 | 20 | 60 | 20 | Ca:0.002 | 3.39 |
| 9† | 0.10 | 0.25 | 2.0 | 0.35 | — | — | 0.46 | 0.03 | 0.06 | 0.016 | 0.03 | <3 | — | 90 | 20 | Ca:0.002 | 2.0475 |
| 10† | 0.07 | 0.13 | 1.8 | 0.34 | — | 0.20 | 0.38 | 0.02 | — | 0.014 | 0.02 | <3 | — | 90 | 10 | — | 1.734 |
| 11† | 0.07 | 0.06 | 1.8 | 0.36 | — | 0.24 | 0.30 | — | 0.04 | 0.015 | 0.020 | 12 | 16 | 80 | 10 | — | 2.967 |

†Comparison steels

TABLE IV (Metric (S.I.) units)
PROCESSING AND PROPERTIES OF EXAMPLE AND COMPARISON STEELS

| | | PROCESSING CONDITIONS | | | | | | | PROPERTIES | | | | | WELD-ABILITY |
|---|---|---|---|---|---|---|---|---|---|---|---|---|---|---|
| | PLATE THICK- | Reheat | Reductn | Finish | Quenching (Cooling) | Quench (Cool) Stop | MICRO-STRUCTURE | | Base Metal | | | 50% | HAZ | Preheat |
| STEEL ID | NESS mm | Temp. °C. | <950° C. % | Temp. °C. | Rate °C./s | Temp. °C. | MA % | B + M % | YS MPa | TS MPa | vE-40 J | vTrs °C. | vE-20 J | Tempera-ture °C. |
| 1 | 16 | 1100 | 68 | 820 | 20 | 400 | 7 | >90 | 794 | 968 | 264 | −95 | 152 | NR††† |
| 1 | 16 | 1200 | 68 | 750 | 20 | 250 | 5 | >90 | 794 | 993 | 287 | −100 | 152 | NR |
| 2 | 20 | 1150 | 80 | 850 | 20 | 380 | 6 | >90 | 842 | 1015 | 282 | −100 | 169 | NR |
| 2 | 20 | 1150 | 80 | 750 | 35 | 350 | 4 | >90 | 815 | 1032 | 296 | −105 | 169 | NR |
| 3 | 20 | 1150 | 60 | 820 | 17 | 330 | 6 | >90 | 865 | 1068 | 242 | −110 | 135 | NR |
| 4 | 20 | 1150 | 60 | 800 | 17 | 400 | 6 | >90 | 796 | 1008 | 238 | −90 | 147 | NR |
| 5 | 16 | 1150 | 68 | 780 | 20 | 350 | 5 | >90 | 809 | 987 | 247 | −100 | 276 | NR |
| 5 | 20 | 1150 | 60 | 780 | 25 | 350 | 6 | >90 | 770 | 998 | 268 | −100 | 276 | NR |
| 6 | 20 | 1100 | 80 | 720 | 17 | 420 | 4 | >90 | 848 | 1022 | 271 | −105 | 259 | NR |
| 6 | 25 | 1100 | 75 | 820 | 15 | 380 | 5 | >90 | 824 | 1018 | 292 | −110 | 259 | NR |
| 7 | 20 | 1150 | 60 | 800 | 17 | 400 | 6 | >90 | 808 | 1010 | 287 | −95 | 246 | NR |
| 8 | 20 | 1150 | 60 | 800 | 25 | 350 | 6 | >90 | 876 | 1056 | 301 | −115 | 284 | NR |
| 2† | 20 | 1300 | 80 | 760 | 20 | 350 | 14 | >90 | 846 | 1044 | 155 | −85 | 169 | NR |
| 2† | 20 | 1150 | 80 | 820 | 17 | 500 | 8 | 85 | 681 | 946 | 94 | −50 | 169 | NR |
| 2† | 20 | 1150 | 80 | 820 | 17 | RT†† | 8 | >90 | 867 | 1112 | 133 | −75 | 169 | NR |
| 2† | 20 | 1150 | 80 | 820 | 7 | 350 | 8 | 60 | 731 | 891 | 105 | −55 | 169 | NR |
| 5† | 20 | 1150 | 80 | 650 | 17 | 350 | 6 | 80 | 737 | 970 | 121 | −60 | 276 | NR |
| 5† | 20 | 1150 | 35 | 800 | 17 | 350 | 15 | >90 | 800 | 1013 | 99 | −70 | 276 | NR |
| 9† | 20 | 1150 | 80 | 800 | 17 | 350 | 7 | >90 | 841 | 1025 | 104 | −65 | 43 | 80° C. |
| 10† | 20 | 1150 | 80 | 800 | 17 | 350 | 9 | 80 | 582 | 746 | 156 | −85 | 38 | NR |
| 11† | 20 | 1150 | 80 | 800 | 17 | 350 | 17 | >90 | 834 | 1043 | 139 | −70 | 83 | NR |

†Comparison steels;
††Room Temperature;
†††Not Required

TABLE V (English units)
PROCESSING AND PROPERTIES OF EXAMPLE AND COMPARISON STEELS

| | | PROCESSING CONDITIONS | | | | | | | PROPERTIES | | | | | WELD-ABILITY |
|---|---|---|---|---|---|---|---|---|---|---|---|---|---|---|
| | PLATE THICK- | Reheat | Reductn | Finish | Quenching (Cooling) | Quench (Cool) Stop | MICRO-STRUCTURE | | Base Metal | | | 50% | HAZ | Preheat |
| STEEL ID | NESS inches | Temp. °F. | <1742° C. % | Temp. °F. | Rate °F./s | Temp. °F. | MA % | B + M % | YS ksi | TS ksi | vE-40 ft-lbs | vTrs °F. | vE-20 ft-lbs | Tempera-ture °F. |
| 1 | .6 | 2012 | 68 | 1508 | 36 | 752 | 7 | >90 | 115 | 140 | 195 | −139 | 112 | NR††† |
| 1 | .6 | 2192 | 68 | 1382 | 36 | 482 | 5 | >90 | 115 | 144 | 212 | −148 | 112 | NR |
| 2 | .8 | 2102 | 80 | 1562 | 36 | 716 | 6 | >90 | 122 | 147 | 208 | −148 | 125 | NR |
| 2 | .8 | 2102 | 80 | 1382 | 63 | 662 | 4 | >90 | 118 | 150 | 218 | −157 | 125 | NR |
| 3 | .8 | 2102 | 60 | 1508 | 31 | 626 | 6 | >90 | 125 | 155 | 178 | −166 | 100 | NR |
| 4 | .8 | 2102 | 60 | 1472 | 31 | 752 | 6 | >90 | 115 | 146 | 175 | −130 | 108 | NR |
| 5 | .6 | 2102 | 68 | 1436 | 36 | 662 | 5 | >90 | 117 | 143 | 182 | −148 | 203 | NR |
| 5 | .8 | 2102 | 60 | 1436 | 45 | 662 | 6 | >90 | 112 | 145 | 198 | −148 | 203 | NR |
| 6 | .8 | 2012 | 80 | 1328 | 31 | 788 | 4 | >90 | 123 | 148 | 200 | −157 | 191 | NR |
| 6 | 1 | 2012 | 75 | 1508 | 27 | 716 | 5 | >90 | 119 | 148 | 215 | −166 | 191 | NR |
| 7 | .8 | 2102 | 60 | 1472 | 31 | 752 | 6 | >90 | 117 | 146 | 212 | −139 | 181 | NR |
| 8 | .8 | 2102 | 60 | 1472 | 45 | 662 | 6 | >90 | 127 | 153 | 222 | −175 | 209 | NR |
| 2† | .8 | 2372 | 80 | 1400 | 36 | 662 | 14 | >90 | 123 | 151 | 114 | −121 | 125 | NR |
| 2† | .8 | 2102 | 80 | 1508 | 31 | 932 | 8 | 85 | 99 | 137 | 69 | −58 | 125 | NR |
| 2† | .8 | 2102 | 80 | 1508 | 31 | RT†† | 8 | >90 | 126 | 161 | 98 | −103 | 125 | NR |
| 2† | .8 | 2102 | 80 | 1508 | 13 | 662 | 8 | 60 | 106 | 129 | 77 | −67 | 125 | NR |
| 5† | .8 | 2102 | 80 | 1202 | 31 | 662 | 6 | 80 | 107 | 141 | 89 | −76 | 203 | NR |
| 5† | .8 | 2102 | 35 | 1472 | 31 | 662 | 15 | >90 | 116 | 147 | 73 | −94 | 203 | NR |
| 9† | .8 | 2102 | 80 | 1472 | 31 | 662 | 7 | >90 | 122 | 149 | 77 | −85 | 32 | 176° F. |

TABLE V-continued (English units)
PROCESSING AND PROPERTIES OF EXAMPLE AND COMPARISON STEELS

| | | PROCESSING CONDITIONS | | | | | MICRO- | | PROPERTIES | | | | | WELD- |
|---|---|---|---|---|---|---|---|---|---|---|---|---|---|---|
| | PLATE | | | | Quenching | Quench | | | Base Metal | | | | | ABILITY |
| | THICK- | Reheat | Reductn | Finish | (Cooling) | (Cool) Stop | STRUCTURE | | | | | 50% | HAZ | Preheat |
| STEEL ID | NESS inches | Temp. °F. | <1742° C. % | Temp. °F. | Rate °F./s | Temp. °F. | MA % | B + M % | YS ksi | TS ksi | vE-40 ft-lbs | vTrs °F. | vE-20 ft-lbs | Tempera-ture °F. |
| 10† | .8 | 2102 | 80 | 1472 | 31 | 662 | 9 | 80 | 84 | 108 | 115 | −121 | 28 | NR |
| 11† | .8 | 2102 | 80 | 1472 | 31 | 662 | 17 | >90 | 121 | 151 | 102 | −94 | 61 | NR |

†Comparison steels;
††Room Temperature;
†††Not Required

This ULTT embodiment of the current invention permits stable mass production of steels for ultra-high strength linepipes (of API X100 or above with a tensile strength of 930 MPa or above) having excellent field weldability and low temperature toughness. This leads to significant improvement in pipeline design and transport and installation efficiencies.

Steels having the compositions of this ULTT embodiment, and processed according to the method described herein, are suitable for a wide variety of applications, including linepipe for the transport of natural gas or crude oils, various types of welded pressure vessels, and industrial machines.

While the foregoing invention has been described in terms of one or more preferred embodiments, it should be understood that other modifications may be made without departing from the scope of the invention, which is set forth in the following claims.

GLOSSARY OF TERMS $Ac_1$ transformation point: the temperature at which austenite begins to form during heating;

$Ar_1$ transformation point: the temperature at which transformation of austenite to ferrite or to ferrite plus cementite is completed during cooling;

$Ar_3$ transformation point: the temperature at which austenite begins to transform to ferrite during cooling;

B+M: mixture of fine-grained lower bainite and fine-grained lath martensite;

cementite: iron carbides;

Ceq (carbon equivalent): a well-known industry term used to express weldability; also, Ceq=(wt % C+wt % Mn/6+(wt % Cr+wt % Mo+wt % V)/5+(wt % Cu+wt % Ni)/15);

ESSP: an index related to shape-controlling of sulfide inclusions in steel; also ESSP=(wt % Ca)[1−124(wt % O)]/1.25(wt % S);

$Fe_{23}(C,B)_6$: a form of iron borocarbide;

HAZ: heat-affected zone;

heavy rolling: reduction in thickness of more than about 50%;

IDQ: Interrupted Direct Quenching;

lean chemistry: Ceq less than about 0.50;

MA: martensite-austenite constituent;

$Mo_2C$: a form of molybdenum carbide;

Nb(C,N): carbonitrides of niobium;

Pcm: a well-known industry term used to express weldability; also, Pcm=(wt % C+wt % Si/30+(wt % Mn+wt % Cu+wt % Cr)/20+wt % Ni/60+wt % Mo/15+wt % V/10+5(wt % B));

predominantly: as used in describing the present invention, means at least about 50 volume percent;

P-Value, for essentially boron-free steels: 2.7C+0.4Si+Mn+0.8Cr+0.45(Ni+Cu)+Mo+V−1, where the C, Si, Mn, Cr, Ni, Cu, Mo and V are expressed in weight percent;

P-Value, for boron-containing steels: 2.7C+0.4Si+Mn+0.8Cr+0.45(Ni+Cu)+2Mo+V, where the C, Si, Mn, Cr, Ni, Cu, Mo and V are expressed in weight percent;

quenching: as used in describing the present invention, accelerated cooling by any means whereby a fluid selected for its tendency to increase the cooling rate of the steel is utilized, as opposed to air cooling;

quenching (cooling) rate: cooling rate at the center, or substantially at the center, of the plate thickness;

Quench Stop Temperature (QST): the highest, or substantially the highest, temperature reached at the surface of the plate, after quenching is stopped, because of heat transmitted from the mid-thickness of the plate;

REM: Rare Earth Metals;

$T_{nr}$ temperature: the temperature below which austenite does not recrystallize;

TS: tensile strength;

V(C,N): carbonitrides of vanadium;

$vE_{-20}$: impact energy by Charpy V-notch impact test at −20° C. (−4° F.);

$vE_{-40}$: impact energy determined by Charpy V-notch impact test at −40° C. (−40° F.);

vTrs: transition temperature determined by Charpy V-notch impact test;

50% vTrs: experimental measurement and extrapolation from Charpy V-notch impact test of the lowest temperature at which the fracture surface displays 50% by area shear fracture;

YS: yield strength.

We claim:

1. A steel plate having a tensile strength of at least about 930 MPa (135 ksi), an impact energy by Charpy V-notch test at −40° C. (−40° F.) of greater than about 120 J (88 ft-lb), a 50% vTrs of less than about −60° C. (−76° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, and wherein said steel plate is produced from a reheated steel comprising iron and the following alloying elements in the weight percents indicated:

about 0.05% to about 0.10% C,
about 1.7% to about 2.1% Mn,
less than about 0.015% P,
less than about 0.003% S,
about 0.2% to about 1.0% Ni,
about 0.01% to about 0.10% Nb,
0% to 0.8% Cu,
about 0.005% to about 0.03% Ti, and
about 0.25% to about 0.6% Mo.

2. The steel of claim 1 further comprising at least one additive selected from the group consisting of (i) 0 wt % to about 0.6 wt % Si, and (ii) 0 wt % to about 0.06 wt % Al.

3. The steel of claim 1 being essentially boron-free and having a P-Value of about 1.9 to about 2.8, wherein said Mo content is at least about 0.35 wt % and said P-Value is defined as: P-Value=2.7C+0.4Si+Mn+0.8Cr+0.45(Ni+Cu)+Mo+V−1 (where the alloying elements C, Si, Mn, Cr, Ni, Cu, Mo and V are expressed in weight percent).

4. The steel of claim 3 further comprising at least one additive selected from the group consisting of (i) about 0.01 wt % to about 0.1 wt % V, and (ii) about 0.1 wt % to about 0.8 wt % Cr.

5. The steel of claim 1 further comprising about 0.0006 wt % to about 0.0020 wt % B, and having a P-Value of about 2.5 to about 3.5, wherein said P-Value is defined as: P-Value=2.7C+0.4Si+Mn+0.8Cr+0.45(Ni+Cu)+2Mo+V (where the alloying elements C, Si, Mn, Cr, Ni, Cu, Mo and V are expressed in weight percent).

6. The steel of claim 5 further comprising at least one additive selected from the group consisting of (i) about 0.01 wt % to about 0.1 wt % V, and (ii) about 0.1 wt % to about 0.8 wt % Cr.

7. The steel according to claims 1, 2, 3, 4, 5, or 6 further comprising about 0.001 wt % to about 0.006 wt % calcium, about 0.001 wt % to about 0.02 wt % REM, and about 0.0001 to about 0.006 wt % magnesium.

8. A method for preparing a steel plate having a tensile strength of at least about 930 MPa (135 ksi), an impact energy by Charpy V-notch test at −40° C. (−40° F.) of greater than about 120 J (88 ft-lb), a 50% vTrs of less than about −60° C. (−76° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, said method comprising the steps:

(a) heating a steel slab to a temperature in the range of about 1050° C. (1922° F.) to about 1250° C. (2282° F.);

(b) reducing said slab to form plate in one or more hot rolling passes in a first temperature range in which austenite recrystallizes;

(c) further reducing said plate in one or more hot rolling passes in a second temperature range in which austenite does not recrystallize, wherein a reduction in thickness of more than about 50 percent occurs in said second temperature range and said hot rolling is finished at a finish rolling temperature greater than both about 700° C. (1292° F.) and the $Ar_3$ transformation point;

(d) quenching said plate at a rate of at least about 10° C./sec (18° F./sec) to a Quench Stop Temperature in the range of about 450° C. to about 200° C. (842° F.–392° F.); and (e) stopping said quenching and allowing said plate to air cool to ambient temperature, so as to facilitate completion of transformation of said steel plate to at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns.

9. The method of claim 8 wherein said second temperature range of step (c) is below about 950° C. (1742° F.).

10. The method of claim 8 wherein said finish rolling temperature of step (c) is below about 850° C. (1562° F.).

11. A steel plate having a tensile strength of at least about 930 MPa (135 ksi), an impact energy by Charpy V-notch test at −40° C. (−40° F.) of greater than about 120 J (88 ft-lb), a 50% vTrs of less than about −60° C. (−76° F.), and a microstructure comprising less than about 8 volume percent of martensite-austenite constituent and at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, and wherein said steel plate is produced from a reheated steel comprising iron and the following alloying elements in the weight percents indicated:

about 0.05% to about 0.10% C,
about 1.7% to about 2.1% Mn,
less than about 0.015% P,
less than about 0.003% S,
about 0.2% to about 1.0% Ni,
about 0.01% to about 0.10% Nb,
0% to 0.8% Cu,
about 0.005% to about 0.03% Ti, and
about 0.25% to about 0.6% Mo.

12. The steel of claim 11 further comprising at least one additive selected from the group consisting of (i) 0 wt % to about 0.6 wt % Si, and (ii) 0 wt % to about 0.06 wt % Al.

13. The steel of claim 11 being essentially boron-free and having a P-Value of about 1.9 to about 2.8, wherein said Mo content is preferably at least about 0.35 wt % and said P-Value is defined as: P-Value=2.7C+0.4Si+Mn+0.8Cr+0.45(Ni+Cu)+Mo+V−1 (where the alloying elements C, Si, Mn, Cr, Ni, Cu, Mo and V are expressed in weight percent).

14. The steel of claim 13 further comprising at least one additive selected from the group consisting of (i) about 0.01 wt % to about 0.1 wt % V, and (ii) about 0.1 wt % to about 0.8 wt % Cr.

15. The steel of claim 11 further comprising about 0.0006 wt % to about 0.0020 wt % B, and having a P-Value of about 2.5 to about 3.5, wherein said P-Value is defined as: P-Value=2.7C+0.4Si+Mn+0.8Cr+0.45(Ni+Cu)+2Mo+V (where the alloying elements C, Si, Mn, Cr, Ni, Cu, Mo and V are expressed in weight percent).

16. The steel of claim 15 further comprising at least one additive selected from the group consisting of (i) about 0.01 wt % to about 0.1 wt % V, and (ii) about 0.1 wt % to about 0.8 wt % Cr.

17. The steel according to claims 11, 12, 13, 14, 15, or 16 further comprising about 0.001 wt % to about 0.006 wt % calcium, about 0.001 wt % to about 0.02 wt % REM, and about 0.0001 to about 0.006 wt % magnesium.

18. A method for preparing a steel plate having a tensile strength of at least about 930 MPa (135 ksi), an impact energy by Charpy V-notch test at −40° C. (−40° F.) of greater than about 120 J (88 ft-lb), a 50% vTrs of less than about −60° C. (−76° F.), and a microstructure comprising less than about 8 volume percent of martensite-austenite constituent and at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, said method comprising the steps:

(a) heating a steel slab to a temperature in the range of about 1050° C. (1922° F.) to about 1250° C. (2282° F.);

(b) reducing said slab to form plate in one or more hot rolling passes in a first temperature range in which austenite recrystallizes;

(c) further reducing said plate in one or more hot rolling passes in a second temperature range in which austenite does not recrystallize, wherein a reduction in thickness of more than about 50 percent occurs in said second temperature range and said hot rolling is finished at a finish rolling temperature greater than both about 700° C. (1292° F.) and the $Ar_3$ transformation point;

(d) quenching said plate at a rate of at least about 10° C./sec (18° F./sec) to a Quench Stop Temperature in the range of about 450° C. to about 200° C. (842° F.–392° F.); and (e) stopping said quenching and allowing said plate to air cool to ambient temperature, so as to facilitate completion of transformation of said steel plate to less than about 8 volume percent martensite-austenite constituent and at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns.

19. The method of claim 18 wherein said second temperature range of step (c) is below about 950° C. (1742° F.).

20. The method of claim 18 wherein said finish rolling temperature of step (c) is below about 850° C. (1562° F.).

21. A steel plate having a tensile strength of at least about 930 MPa (135 ksi), an impact energy by Charpy V-notch test at −40° C. (−40° F.) of greater than about 175 J (129 ft-lb), a 50% vTrs of less than about −60° C. (−76° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, and wherein said steel plate is produced from a reheated steel comprising iron and the following alloying elements in the weight percents indicated:

about 0.05% to about 0.10% C,
about 1.7% to about 2.1% Mn,
less than about 0.015% P,
less than about 0.003% S,
about 0.2% to about 1.0% Ni,
about 0.01% to about 0.10% Nb,
0% to 0.8% Cu,
about 0.005% to about 0.03% Ti, and
about 0.25% to about 0.6% Mo.

22. The steel of claim 21 further comprising at least one additive selected from the group consisting of (i) 0 wt % to about 0.6 wt % Si, and (ii) 0 wt % to about 0.06 wt % Al.

23. The steel of claim 21 being essentially boron-free and having a P-Value of about 1.9 to about 2.8, wherein said Mo content is preferably at least about 0.35 wt % and said P-Value is defined as: P-Value=2.7C+0.4Si+Mn+0.8Cr+0.45(Ni+Cu)+Mo+V−1 (where the alloying elements C, Si, Mn, Cr, Ni, Cu, Mo and V are expressed in weight percent).

24. The steel of claim 23 further comprising at least one additive selected from the group consisting of (i) about 0.01 wt % to about 0.1 wt % V, and (ii) about 0.1 wt % to about 0.8 wt % Cr.

25. The steel of claim 21 further comprising about 0.0006 wt % to about 0.0020 wt % B, and having a P-Value of about 2.5 to about 3.5, wherein said P-Value is defined as: P-Value=2.7C+0.4Si+Mn+0.8Cr+0.45(Ni+Cu)+2Mo+V (where the alloying elements C, Si, Mn, Cr, Ni, Cu, Mo and V are expressed in weight percent).

26. The steel of claim 25 further comprising at least one additive selected from the group consisting of (i) about 0.01 wt % to about 0.1 wt % V, and (ii) about 0.1 wt % to about 0.8 wt % Cr.

27. The steel according to claims 21, 22, 23, 24, 25 or 26, further comprising about 0.001 wt % to about 0.006 wt % calcium, about 0.001 wt % to about 0.02 wt % REM, and about 0.0001 to about 0.006 wt % magnesium.

28. A method for preparing a steel plate having a tensile strength of at least about 930 MPa (135 ksi), an impact energy by Charpy V-notch test at −40° C. (−40° F.) of greater than about 175 J (129 ft-lb), a 50% vTrs of less than about −60° C. (−76° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, said method comprising the steps:

(a) heating a steel slab to a temperature in the range of about 1050° C. (1922° F.) to about 1250° C. (2282° F.);

(b) reducing said slab to form plate in one or more hot rolling passes in a first temperature range in which austenite recrystallizes;

(c) further reducing said plate in one or more hot rolling passes in a second temperature range in which austenite does not recrystallize, wherein a reduction in thickness of more than about 50 percent occurs in said second temperature range and said hot rolling is finished at a finish rolling temperature greater than both about 700° C. (1292° F.) and the $Ar_3$ transformation point;

(d) quenching said plate at a rate of at least about 10° C./sec (18° F./sec) to a Quench Stop Temperature in the range of about 450° C. to about 200° C. (842° F.–392° F.); and (e) stopping said quenching and allowing said plate to air cool to ambient temperature, so as to facilitate completion of transformation of said steel plate to at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns.

29. The method of claim 28 wherein said second temperature range of step (c) is below about 950° C. (1742° F.).

30. The method of claim 28 wherein said finish rolling temperature of step (c) is below about 850° C. (1562° F.).

31. A steel plate having a tensile strength of at least about 930 MPa (135 ksi), an impact energy by Charpy V-notch test at −40° C. (−40° F.) of greater than about 175 J (129 ft-lb), a 50% vTrs of less than about −85° C. (−121° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, and wherein said steel plate is produced from a reheated steel comprising iron and the following alloying elements in the weight percents indicated:

about 0.05% to about 0.10% C,
about 1.7% to about 2.1% Mn,
less than about 0.015% P,
less than about 0.003% S,
about 0.2% to about 1.0% Ni,
about 0.01% to about 0.10% Nb,
0% to 0.8% Cu,
about 0.005% to about 0.03% Ti, and
about 0.25% to about 0.6% Mo.

32. The steel of claim 31 further comprising at least one additive selected from the group consisting of (i) 0 wt % to about 0.6 wt % Si, and (ii) 0 wt % to about 0.06 wt % Al.

33. The steel of claim 31 being essentially boron-free and having a P-Value of about 1.9 to about 2.8, wherein said Mo content is preferably at least about 0.35 wt % and said P-Value is defined as: P-Value=2.7C+0.4Si+Mn+0.8Cr+0.45(Ni+Cu)+Mo+V−1 (where the alloying elements C, Si, Mn, Cr, Ni, Cu, Mo and V are expressed in weight percent).

34. The steel of claim 33 further comprising at least one additive selected from the group consisting of (i) about 0.01 wt % to about 0.1 wt % V, and (ii) about 0.1 wt % to about 0.8 wt % Cr.

35. The steel of claim 31 further comprising about 0.0006 wt % to about 0.0020 wt % B, and having a P-Value of about 2.5 to about 3.5, wherein said P-Value is defined as: P-Value=2.7C+0.4Si+Mn+0.8Cr+0.45(Ni+Cu)+2Mo+V (where the alloying elements C, Si, Mn, Cr, Ni, Cu, Mo and V are expressed in weight percent).

36. The steel of claim 35 further comprising at least one additive selected from the group consisting of (i) about 0.01 wt % to about 0.1 wt % V, and (ii) about 0.1 wt % to about 0.8 wt % Cr.

37. The steel according to claims 31, 32, 33, 34, 35, or 36 further comprising about 0.001 wt % to about 0.006 wt % calcium, about 0.001 wt % to about 0.02 wt % REM, and about 0.0001 to about 0.006 wt % magnesium.

38. A method for preparing a steel plate having a tensile strength of at least about 930 MPa (135 ksi), an impact energy by Charpy V-notch test at −40° C. (−40° F.) of greater than about 175 J (129 ft-lb), a 50% vTrs of less than about −85° C. (−121° F.), and a microstructure comprising at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns, said method comprising the steps:

(a) heating a steel slab to a temperature in the range of about 1050° C. (1922° F.) to about 1250° C. (2282° F.);

(b) reducing said slab to form plate in one or more hot rolling passes in a first temperature range in which austenite recrystallizes;

(c) further reducing said plate in one or more hot rolling passes in a second temperature range in which austenite does not recrystallize, wherein a reduction in thickness of more than about 50 percent occurs in said second temperature range and said hot rolling is finished at a finish rolling temperature greater than both about 700° C. (1292° F.) and the $Ar_3$ transformation point;

(d) quenching said plate at a rate of at least about 10° C./sec (18° F./sec) to a Quench Stop Temperature in the range of about 450° C. to about 200° C. (842° F.–392° F.); and (e) stopping said quenching and allowing said plate to air cool to ambient temperature, so as to facilitate completion of transformation of said steel plate to at least about 90 volume percent of a mixture of fine-grained lower bainite and fine-grained lath martensite, wherein at least about ⅔ of said mixture consists of fine-grained lower bainite transformed from unrecrystallized austenite having an average grain size of less than about 10 microns.

39. The method of claim 38 wherein said second temperature range of step (c) is below about 950° C. (1742° F.).

40. The method of claim 38 wherein said finish rolling temperature of step (c) is below about 850° C. (1562° F.).

* * * * *